US012221318B1

(12) United States Patent
McCormick

(10) Patent No.: US 12,221,318 B1
(45) Date of Patent: Feb. 11, 2025

(54) UNIT FOR POWERED WIND/UNWIND OF DUCT RODDERS

(71) Applicant: CHRIS MCCORMICK, INCORPORATED, Pleasantville, IA (US)

(72) Inventor: Chris McCormick, Pleasantville, IA (US)

(73) Assignee: CHRIS MCCORMICK, INCORPORATED, Pleasantville, IA (US)

( * ) Notice: Subject to any disclaimer, the term of this patent is extended or adjusted under 35 U.S.C. 154(b) by 86 days.

(21) Appl. No.: 17/806,806

(22) Filed: Jun. 14, 2022

Related U.S. Application Data

(60) Provisional application No. 63/202,493, filed on Jun. 14, 2021.

(51) Int. Cl.
*B65H 75/30* (2006.01)

(52) U.S. Cl.
CPC ..... *B65H 75/305* (2013.01)

(58) Field of Classification Search
CPC ..... B65H 75/403; B65H 23/038; B65H 2701/51; B65H 57/00; B65H 57/04; B65H 57/12; B65H 75/247; B65H 75/249; B65H 75/446; A47K 10/34; A47K 10/36
USPC ..... 242/557
See application file for complete search history.

(56) References Cited

U.S. PATENT DOCUMENTS 1,939,796 A * 12/1933 Spowart ..... H02G 1/08 226/49
5,139,751 A * 8/1992 Mansfield ..... B65H 51/10 137/355.2
7,309,060 B2 * 12/2007 Baughman ..... B65H 75/305 254/134.3 R
10,669,117 B2 * 6/2020 Hunt ..... B65H 51/06
11,136,213 B2 * 10/2021 Russell ..... B65H 75/30

OTHER PUBLICATIONS

Flex-Grip Drive Rollers, 2497K15, Spec Sheet [online], McMaster-Carr Supply Company, 2015. Retrieved from the Internet on Apr. 14, 2021 <URL:https://www.mcmaster.com/flex-grip-drive-rollers/>, 2 pages.

* cited by examiner

*Primary Examiner* — Sang K Kim
(74) *Attorney, Agent, or Firm* — McKee, Voorhees & Sease, PLC

(57) ABSTRACT

An apparatus, method, and system for power unwinding and winding of coiled duct rodding on a duct rodder or other coiled conduit. A unit can be mounted to a duct rodder stand or other coiled conduit stand. The unit includes a rotatable axle having a drive wheel at one end and an opposite end that is adapted for releasable connection to the chuck of a battery powered portable drill or driver. When connected to the drill or driver, the drive wheel can be rotated in opposite directions by the detachable battery powered drill or tool. An optional pinching wheel on the unit can be adjusted relative the drive wheel to provide adjustable pinching pressure on duct rod or other conduit to facilitate movement of duct rodding or other conduit in response to drive wheel rotation. In one example, the drive wheel and pinch wheel are on a frame that can be removably clamped to a stand that supports a cage or reel of coiled duct rodding or other conduit.

13 Claims, 29 Drawing Sheets

Component Parts of a Duct Rodder

FLEX-GRIP DRIVE ROLLERS

THE TEARDROP-SHAPED SIDEWALL HOLES AND SOFT SURFACE ALLOW THE ROLLER TO GENTLY GRAB AND MAINTAIN CONTACT AS IT IS COMPRESSED. PERFECT FOR BOLTING AND SHEET METAL APPLICATIONS. THESE ROLLERS HAVE TAPPED HUBS THAT ALLOW YOU TO MOUNT THEN ONTO A SHAFT OR STUD WITH TWO SET SCREWS (INCLUDED) TO TRANSMIT POWER. HUB IS MADE OF STEEL..

OIL-RESISTANT NEOPRENE-- THESE ROLLERS RESIST OIL, FLAMES, GASOLINE, AND WEATHER. TEMPERATURE RANGE IS -40° TO 200°F. COLOR IS BLACK

OIL-RESISTANT BUNA-N-- THESE ROLLERS ARE ALSO ABRASION RESISTANT AND NONMARRING. TEMPERATURE RANGE IS -60° TO 175°F. COLOUR IS WHITE.

ABRASION RESISTANT-- THESE URETHENE ROLLERS ARE WEAR AND CHEMICAL RESISTANT. THEY'RE ALSO NONMARRING- TEMPERATURE RANGE IS -65° TO 200°F. COLOUR IS YELLOW

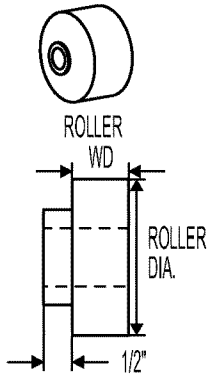

| ROLLER DIA. | ROLLER WD. | FOR SHAFT DIA. | OIL-RESISTANT NEOPRENE 20A (SOFT) DUROMETER | | OIL-RESISTANT NEOPRENE | OIL-RESISTANT BUNA-N 20A (SOFT) DUROMETER | | OIL-RESISTANT BUNA-N 35A (SOFT) DUROMETER | | ABRASION-RESISTANT URETHANE 35A (SOFT) DUROMETER | |
|---|---|---|---|---|---|---|---|---|---|---|---|
| 4" | 28/32" | 3/4" | 2497K2 | $37.84 | 2497K12 | 2498K2 | $43.00 | 2498K12 | $43.00 | 1536T21 | $60.72 |
| 4" | 28/32" | 1" | 2497K3 | 30.78 | 2497K13 | 2498K2 | 35.58 | 2498K13 | 54.00 | 1536T22 | 50.78 |
| 4" | 1 15/16" | 3/4" | 2497K5 | 40.64 | 2497K15 | 2498K2 | 46.18 | 2498K18 | 46.00 | 1536T23 | 63.70 |
| 4" | 1 15/16 | 1" | 2497K6 | 31.00 | 2497K16 | 2498K2 | 36.32 | 2498K92 | 35.00 | 1536T24 | 61.96 |

KEYED DRIVE ROLLERS

USE ROLLERS WITH A KEYED SHAFT TO PREVENT SLIPPAGE IN HIGH-TORQUE APPLICATIONS. DRIVE ROLLERS SPIN IN UNISON WITH A SHAFT OR STUD TO TRANSMIT POWER. THEY MOUNT TO THE SHAFT WITH TWO SET SCREWS (INCLUDED). SEE PAGE 3774 FOR DUROMETER INFORMATION.

OIL RESISTANT -- A GOOD CHOICE FOR OILY ENVIRONMENTS, THESE BUNA-N ROLLERS ARE ALSO ABRASION RESISTANT AND NONMARRING. DUROMETER IS 704 (HAND). TEMPERATURE RANGE IS -20° TO -180°F. COLOR IS BLACK.

ABRASION RESISTANT-- THESE URETHANE ROLLERS ARE WEAR AND CHEMICAL RESISTANT. THEY'RE ALSO NONMARRING. DUROMETER IS 35A(HARD). TEMPERATURE RANGE IS -20° TO -120°F. COLOR IS RED.

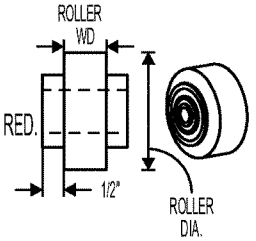

| ROLLER DIA. | ROLLER WD. | FOR SHAFT DIA. | KEYWAY WD.XDP. | O'ALL WD. | OIL RESISTANT DYNAMIC LOAD CAP. LBS. | | ABRASION RESISTANT DYNAMIC LOAD CAP. LBS | |
|---|---|---|---|---|---|---|---|---|
| 3" | 2" | 1/2" | 1/8" x 1/16" | 3 1/4" | 300 | 61065K51◇ $52.24 | | |
| 3" | 2" | 3/4" | 3/16" x 3/32" | 3 1/4" | 300 | 61065K52◇ 52.52 | 300 2478K42 | $60.76 |
| 4" | 2" | 3/4" | 3/16" x 3/32" | 3 1/4" | 350 | 61065K54◇ 77.16 | 350 2478K41 | 75.58 |
| 5" | 2" | 3/4" | 3/16" x 3/32" | 3 1/4" | 400 | 61065K56 86.00 | 400 2478K46 | 114.34 |
| 6" | 2" | 3/4" | 3/16" x 3/32" | 3 1/4" | 425 | 61065K58 90.00 | 425 2478K47 | 110.86 |
| 6" | 3" | 3/4" | 3/16" x 3/32" | 3 1/4" | 500 | 61065K46 112.60 | | |
| 6" | 3" | 1" | 1/4" x 1/8" | 3 1/4" | 500 | 61065K47 111.00 | 1,600 2478K42 | 141.40 |
| 6" | 3" | 1 1/4" | 1/4" x 1/8" | 3 1/4" | 500 | 61065K48 123.42 | | |
| 8" | 2" | 3/4" | 3/16" x 3/32" | 3 1/4" | 500 | 61065K59 111.34 | 500 2478K42 | 113.00 |
| 8" | 3" | 1" | 1/4" x 1/8" | 3 1/4" | 850 | 61065K17 150.24 | 1,600 2478K45 | 184.342 |
| 8" | 3" | 1 3/4" | 1/4" x 1/8" | 3 1/4" | 850 | 61065K18 148.34 | | |
| 10" | 3" | 1" | 1/4" x 1/8" | 3 1/4" | 1,000 | 61065K23 140.50 | 1,600 2478K43 | 223.14 |
| 10" | 3" | 1 1/4" | 1/4" x 1/8" | 3 1/4" | 1,000 | 61065K24 180.30 | | |

◇ HUB PROTRUDES 1 1/4" O ONE SIDE ONLY.

MCMASTER.CARR.

FIG. 14A

McMASTER-CARR.

FLEX-GRIP DRIVE ROLLERS 2497K15

FOR SHAFT DIAMETR

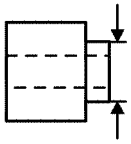

3/4"
1"

ROLLER WIDTH

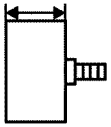

29/32"
1 15/16""

ROLLER MATERIAL
NEOPRENE
URETHANE
BUNA-N

DUROMETER
20A
35A

20 PRODUCTS

ABOUT DUROMETER
DUROMETER IS THE INTERNATIONAL STANDARD FOR MEASURING THE HARDNESS OF RUBBER, PLASTIC, AND MOST NONMETALLIC MATERIALS.
MORE

FLEX-GRIP DRIVE ROLLERS

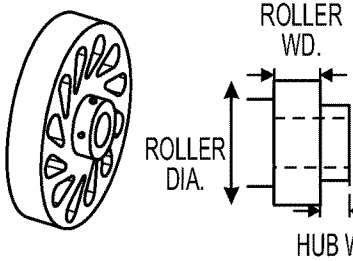

THESE URETHANE ROLLERS ARE NONMARRING AND WEAR RESISTANT. THE TEARDROP-SHAPED SIDEWALL HOLES AND SOFT SURFACE ALLOW THE ROLLER TO GENTLY GRAB AND MAINTAIN CONTACT AS IT IS COMPRESSED. ALSO KNOWN AS CONTACT WHEELS AND FEED ROLLERS, THESE ROLLERS HAVE TAPPED HUBS THAT ALLOW YOU TO MOUNT THEM ONTO A SHAFT OR STUD TO TRANSMIT POWER.

CAD FOR TECHNICAL DRAWINGS AND 3-D MODELS, CLICK ON A PART NUMBER.

| ROLLER | | FOR SHAFT | HUB | | | SET SCREWS | | | | 20A DUROMETER (SOFT) | | 35A DUROMETER (SOFT) | |
|---|---|---|---|---|---|---|---|---|---|---|---|---|---|
| DIA. | WD. | DIA. | DIA. | WD. | SHAFT MOUNT TYPE | NO. REQUIRED | INCLUDED | TEMPERATURE RANGE, °F | COLOR | | EACH | | EACH |
| **NEOPRENE ROLLER WITH STEEL HUB** | | | | | | | | | | | | | |
| 4" | 29/32" | 3/4" | 1 1/4" | 1/2" | SET SCREW | 2 | YES | -40° TO 200° | BLACK | **2497K2** | $30.84 | **2497K12** | $37.62 |
| 4" | 29/32" | 1" | 1 1/4" | 1/2" | SET SCREW | 2 | YES | -40° TO 200° | BLACK | **2497K3** | 30.76 | **2497K13** | 30.53 |
| 4" | 1 15/16" | 3/4" | 1 1/4" | 1/2" | SET SCREW | 2 | YES | -40° TO 200° | BLACK | **2497K5** | 40.64 | **2497K15** | 40.64 |
| 4" | 1 15/16" | 1" | 1 1/4" | 1/2" | SET SCREW | 2 | YES | -40° TO 200° | BLACK | **2497K6** | 30.00 | **2497K16** | 31.00 |

FIG. 14B

COLOR
- BLACK
- YELLOW
- WHITE

MINIMUM TEMPERATURE
- -65° F
- -60° F
- -40° F

MAXIUM TEMPERATURE
- 175° F
- 200° F

HUB DIAMETER

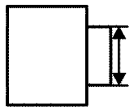

- 1 1/4"
- 1 3/8"

OIL-RESISTANT FLEX-GRIP DRIVE ROLLERS

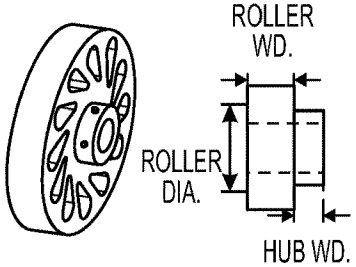

A GOOD CHOICE FOR OILY ENVIRONMENTS, THESE BUNA-N ROLLERS ARE ALSO ABRASION RESISTANT AND NONMARRING. THE TEARDROP-SHAPED SIDEWALL HOLES AND SOFT SURFACE ALLOW THE ROLLER TO GENTLY GRAB AND MAINTAIN CONTACT AS IT IS COMPRESSED. ALSO KNOWN AS CONTACT WHEELS AND FEED ROLLERS, THESE ROLLERS HAVE TAPPED HUBS THAT ALLOW YOU TO MOUNT THEM ONTO A SHAFT OR STUB TO TRANSMIT POWER.

CAD FOR TECHNICAL DRAWINGS AND 3-D MODELS, CLICK ON A PART NUMBER.

| ROLLER | | FOR SHAFT | HUB | | | SET SCREWS | | | | 20A DUROMETER (SOFT) | | 35A DUROMETER (SOFT) | |
|---|---|---|---|---|---|---|---|---|---|---|---|---|---|
| DIA. | WD. | DIA. | DIA. | WD. | SHAFT MOUNT TYPE | NO. REQUIRED | INCLUDED | TEMPERATURE RANGE, °F | COLOR | | EACH | | EACH |
| **NEOPRENE ROLLER WITH STEEL HUB** | | | | | | | | | | | | | |
| 4" | 29/32" | 3/4" | 1 1/4" | 1/2" | SET SCREW | 2 | YES | -60° TO 175° | WHITE | **2498K2** | $43.66 | **2498K12** | $43.00 |
| 4" | 29/32" | 1" | 1 1/4" | 1/2" | SET SCREW | 2 | YES | -60° TO 175° | WHITE | **2498K3** | 35.68 | **2498K13** | 34.40 |
| 4" | 1 15/16" | 3/4" | 1 1/4" | 1/2" | SET SCREW | 2 | YES | -60° TO 175° | WHITE | **2498K5** | 46.18 | **2498K15** | 46.18 |
| 4" | 1 15/16" | 1" | 1 1/4" | 1/2" | SET SCREW | 2 | YES | -60° TO 175° | WHITE | **2498K6** | 36.32 | **2498K16** | 35.92 |

FIG. 14B
(Continued)

CONTACT US ORDER ACTIVITY LOG IN

HOW CAN WE IMPROVE? | PRINT | FORWARD | VIEW CATALOG PAGE

ABRASION-RESISTANT FLEX-GRIP DRIVE ROLLERS

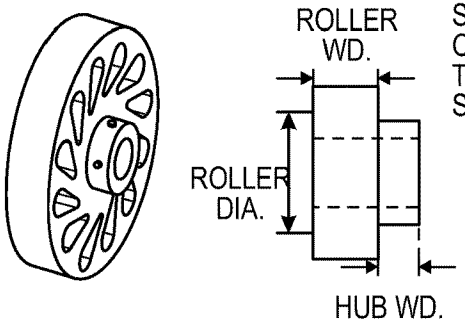

THESE URETHANE ROLLERS ARE NONMARRING AND WEAR RESISTANT. THE TEARDROP-SHAPED SIDEWALL HOLES AND SOFT SURFACE ALLOW THE ROLLER TO GENTLY GRAB AND MAINTAIN CONTACT AS IT IS COMPRESSED. ALSO KNOWN AS CONTACT WHEELS AND FEED ROLLERS, THESE ROLLERS HAVE TAPPED HUBS THAT ALLOW YOU TO MOUNT THEM ONTO A SHAFT OR STUD TO TRANSMIT POWER.

CAD FOR TECHNICAL DRAWINGS AND 3-D MODELS, CLICK ON A PART NUMBER.

| ROLLER | | FOR SHAFT | HUB | | | Set Screws | | | | | |
|---|---|---|---|---|---|---|---|---|---|---|---|
| DIA. | WD. | DIA. | DIA. | WD. | SHAFT MOUNT TYPE | NO. REQUIRED | INCLUDED | TEMPERATURE RANGE, °F | DUROMETER (HARDNESS RATING) | | EACH |
| **URETHANE ROLLER WITH STEEL HUB** | | | | | | | | | | | |
| 4" | 29/32" | 3/4" | 1 1/4" | 1/2" | SET SCREW | 2 | YES | -65° TO 200° | 35A (SOFT) YELLOW | **1536T21** | $60.72 |
| 4" | 29/32" | 1" | 1 3/8" | 1/2" | SET SCREW | 2 | YES | -65° TO 200° | 35A (SOFT) YELLOW | **1536T22** | 50.78 |
| 4" | 1 15/16" | 3/4" | 1 1/4" | 1/2" | SET SCREW | 2 | YES | -65° TO 200° | 35A (SOFT) YELLOW | **1536T23** | 63.70 |
| 4" | 1 15/16" | 1" | 1 3/8" | 1/2" | SET SCREW | 2 | YES | -65° TO 200° | 35A (SOFT) YELLOW | **1536T24** | 51.96 |

FIG. 14C

MCMASTER-CARR

FLEX GRIP DRIVE ROLLERS

FLEX-GRIP DRIVE ROLLER
35A DUROMETER, 4" DIAMETER X 1-15/16" WIDE ROLLER, 1-1/4" HUB DIAMETER

IN STOCK
2497K15

ADD TO ORDER

CAD 3-D SOLIDWORKS DOWNLOAD

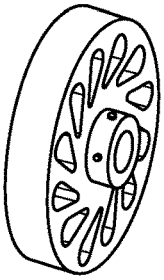

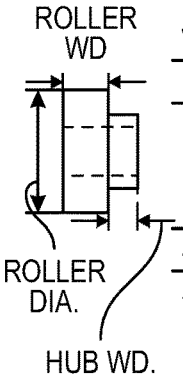

| | |
|---|---|
| GUIDE ROLLER TYPE | DRIVE |
| ROLLER STYLE | SHAFT MOUNT |
| ROLLER PROFILE | FLAT |
| ROLLER MATERIAL | NEOPRENE |
| HUB MATERIAL | STEEL |
| ROLLER | |
| DIAMETER | 4" |
| WIDTH | 1 15/16" |
| FOR SHAFT DIAMETER | 3/4" |
| HUB | |
| DIAMETER | 1 1/4" |
| WIDTH | 1/2" |
| SHAFT MOUNT TYPE | SET SCREW |
| SET SCREWS | |
| NUMBER REQUIRED | 2 |
| INCLUDED | YES |
| TEMPERATURE RANGE | -40 TO 200 F |
| COLOR | BLACK |
| DUROMETER (HARDNESS RATING) | 35A (SOFT) |
| ROHS | ROHS 3 (2015/863/EU) COMPLIANT |
| REACH | REACH (EC 1907/2006) (06/25/2020, 209 SVHC) COMPLIANT |
| DFARS | SPECIALTY METALS COTS-EXEMPT |
| COUNTRY OF ORIGIN | UNITED STATES |
| USMCA QUALIFYING | YES |
| SCHEDULE B | 401699.6000 |
| ECCN | EAR99 |

THESE NEOPRENE ROLLERS ARE WEAR AND CHEMICAL RESISTANT. THE TEARDROP-SHAPED SIDEWALL HOLES AND SOFT SURFACE ALLOW THE ROLLER TO GENTLY GRAB AND MAINTAIN CONTACT AS IT IS COMPRESSED. ALSO KNOW AS CONTACT WHEELS AND FEED ROLLERS, THESE ROLLERS HAVE TAPPED HUBS THAT ALLOW YOU TO MOUNT THEM ONTO A SHAFT OR STUD TO TRANSMIT POWER.

FIG. 14D

UNIT FOR POWERED WIND/UNWIND OF DUCT RODDERS

CROSS-REFERENCE TO RELATED APPLICATIONS

This application claims the benefit of Provisional Application U.S. Ser. No. 63/202,493 filed on Jun. 14, 2021, all of which is herein incorporated by reference in its entirety.

BACKGROUND OF THE INVENTION

A. Field of the Invention

The present invention relates to duct rodders and other coiled conduit and, in particular, to a small, portable powered unwind/wind unit for use with a duct rodder or similar coiled conduit reels to mechanically wind/unwind the rod or conduit from the rodder or conduit reel. Traditionally, duct rodders are manually operated to literally manually pull, hand-over-hand, the duct rod from a coiled state on a reel, and then manually push it back into coiled form on the reel. The same can be true for other coiled conduit, including but limited to flexible tubing or piping, wiring or cables, and solid (e.g. fiberglass) rodding.

B. Problems in the State-of-the-Art

As is well known in the state-of-the-art, duct rodding can involve tens if not hundreds of feet of pulling and pushing from an original coil of duct rod. This is hard manual labor. It takes substantial human energy and time. Similar issues can exist with other coiled conduit. To the extent the following refers to duct rodders holding coiled duct rodding, it is intended to also relate to, where relevant, other coiled conduit.

FIGS. 1A-E show the basic concepts of a duct rodder 1 to unwind or wind duct rodding 3. Conventionally, duct or pulling rod 3 is coiled on a reel or cage 8 that is rotatable on an axle of a stand 9 in a wound or coiled state. The whole unit 1, with coiled duct rod 3, is heavy. A handle 7, and sometimes wheels 2, tries to facilitate movement into location for use on a job-site.

Duct rod 3 conventionally is threaded into pipes or conduits, including those underground, as shown in FIGS. 1A-C. Some duct rodding includes a thin copper wire along its center and/or a copper head on the distal end of the rodding. See FIG. 1D. Threading the duct rod into the underground pipe allows, in one example, an above-ground electromagnetic sensor/reader to detect the duct rod head 5 or the internal copper wire to, in turn, locate the pipe in which the duct rod is being threaded even though the pipe or duct rod cannot be seen. There are other applications for use of a duct rodding.

Sometimes the user needs to thread the duct rod substantial distances. Thus, hand-over-hand pulling of duct rod from its reel 8 for each foot of distance is required. This can require substantial human energy and stamina, but also the labor time. The same is true with pushing extended duct rodding back into a coiled form on reel 8.

One example of a conventional manually-operated duct rodder 1 is shown in FIG. 1E, with its basic components. The coiled pulling rod 3 is coiled on reel or cage 8 that is rotatable on an axle journaled in stand 9. The stand 9 could have wheels 2 to, in some situations, help transport it along the ground or a surface. Some models have a hand-operated brake 4 to help control unwinding or winding, as in well-known to those skilled in the art. In this example, the free distal end of the coiled rod 3 has a copper head 5 which is useful for certain applications. Also shown is a rod guide 6 that guides the rodding 3 as it leaves or returns to cage/reel 8. This version of duct rodder 1 also includes a frame or hand grip 7 to help the user stabilize duct rodder 1 on its stand 9 when unwinding or winding the duct rodding 3. The rodding 3 can be manually pulled/pushed by grabbing the rodding 3 outside of rod guide 6, and manually pushing or pulling rodding 3*a* needed or desired amount. This involves substantial effort. For example, unwinding one-hundred feet of rodding 3 from cage/reel 8 might involve twenty or more pulls. Winding it back onto cage/reel 8 might involve the same or more. Some rodding 3 can be made of flexible and resilient material (e.g. fiberglass), that automatically straightens out when outside the rod guide 6 and can help in unwinding. But, nevertheless, it is all manual work and the worker must grab, hand-over-hand, each succeeding length of rodding 3 and pull or push it off of or onto the cage/reel 8.

Attempts have been made to add at least some form of assistance for unwinding and winding such a duct rodder. As shown in a commercially-available example 10 at FIG. 2A, a hand crank 16 could be connected to a drive train 14 mounted to stand 9 of a duct rodder 1 to take the distal end of pulling rod 3 and move it out and away from duct rodder 1, or pull it back into duct rodder 1. This provides mechanical advantage to unwinding and winding, as opposed to hand-over-hand pulling or pushing of the version of FIG. 1E. However, it still involves manual labor. As shown in FIG. 2A, the unit can be mounted to stand 9 of the duct rodder 1, and is relatively small and unobtrusive, yet its housing to enclose the gearing and its handle extends away from the duct rodder 1. It requires the whole assembly, including gearing or drive train 14 and crank 16 to be mounted onboard duct rodder 3. And it still requires manual work to operate crank 16. This version can include a carrier or bottom frame 12 so that it can be moved around by a motor vehicle to which carrier 12 is mounted.

FIG. 2B shows an attempt to mechanize, with a power source, the winding/unwinding of a duct rodder, here apparatus 20. A quite massive frame 22 supports a duct rod device, such as duct rodder 1 of FIG. 1E. An onboard, gas-powered engine powers a hydraulic motor and pump to turn a wheel 24. As shown in the enlarged view in FIG. 2B, wheel 24 can be positioned to frictionally abut duct rod 3 and push it out or pull it in by friction. A top idler wheel 25 can help push the rod 3 against the drive wheel 24 for frictional grip. As can be seen, however, a gas engine and hydraulic pump 26 and lines 27 result in an overall unit 20 size and weight that is substantially greater than the duct rodder 1 of FIG. 1E. It is therefore difficult to move. It needs to be moved by a forklift or the like. It is of substantial cost and complexity. Its overall size and weight is much more than the duct rodder 1 itself, and requires mounting the whole duct rodder 1 inside the frame 22, so it is not easy to switch between duct rodders 1. The engine and hydraulics are dedicated to that single use.

FIG. 2C illustrates another commercially-available attempt 30 at power-assist unwind and wind a duct rodder 1 and its coiled rod 3. A frame 32 of substantial size and weight holds duct rodder 1 above a set of electrical automobile-type batteries 37. Instead of the manual hand crank of FIG. 2A, an electric motor 34 of the type used to roll and unroll tarps on semi-truck trailers is installed on duct rodder 1. Motor 34 has a rotational output that is connected to the axle of the cage/reel 8 of duct rodder 1 to turn that axle in either direction. While like the system of FIG. 2B this does provide power-assist to unwinding and winding, it is a substantially large frame, substantially heavy with automobile batteries, and thus is difficult to move. It is also costly. Again, the duct rodder 1 must be lifted and mounted on the frame 32, and it is not easy to switch out or switch the drive system between duct rodders 1. The electric motor is dedicated to that single use, and its power source requires the large and heavy automotive style batteries.

It can therefore be seen that the state-of-the-art recognizes a need for power-assisted unwinding and winding of duct rodders. The inventor has identified, however, problems and deficiencies with known attempts. These problems and deficiencies also exist with at least some other coiled conduits.

SUMMARY OF THE INVENTION

A. Objects, Features and Advantages of the Invention

It is therefore a principal object, feature, or advantage of the present invention to improve over the problems and deficiencies in the state-of-the-art.

Other objects, features, and advantages of the present invention include at least one or more of:

a. Hand Portability. Is of a form factor, size, and weight that is much smaller than the duct rodder itself and does not add significant weight or complexity. It can be easily moved to and installed on different duct rodders by hand by one user with basic tools. A mountable assembly is mountable to a duct rodder stand (or support for a cage or reel of other conduct), and includes a drive wheel with connection adapted for selective engagement with a portable rotary power source such as a hand drill.

b. Effectiveness. Has the ability to provide powered unwind and wind smoothly and for conventional ranges of unwinding and winding for a variety of duct rodding or other coiled conduit applications in the field.

c. Economy. It is not costly relative to the cost of the duct rodder itself.

d. Flexibility. It can be a retrofitted as an add-on to existing non-powered duct rodders for a variety of duct rodder styles. It can also be built as original equipment. It can be quickly and easily, with common basic tools, to be removed, reinstalled, or installed on a different duct rodder within minutes.

e. Ease of use and maintenance. Has adjustability for different duct rodding types or other coiled conduit coils, as well as can be fine fine-tuned for effective gripping of different types and diameters of duct rodding or other coiled conduit for unwinding and winding for each application.

f. Durability. Even in sometimes harsh conditions (e.g. rain, cold, muddy, hot, humid, etc.), it is robust and has a long estimated useful life, and low operating costs.

Such considerations also can apply to other types of coiled conduit.

B. Aspects of the Invention

A first aspect of the invention is an apparatus for powered unwinding and winding of a duct rodder or the like. A first component is a relatively small form factor mountable assembly includes a frame that carries a drive wheel and an adjustable pinching wheel for frictionally moving duct rodding between them upon rotation of the drive wheel. The form factor of the mountable assembly is much smaller than the duct rodder itself. Optionally, a pair of guide wheels downstream from the drive wheel on the frame can guide the exit of the duct rodding. An optional guide upstream from the drive wheel on the frame can guide entrance of the duct rodding to the drive and pinching wheels. A clamping or connection end of the frame of the mountable assembly is adapted to be removably fixed to the stand of a duct rodder. In one example it can be a clamped on existing duct rodders for retrofitting. In other examples, it could be a direct bolt-on attachment either as a retrofit or original equipment. The drive wheel includes an axle. A second component is a portable power source that is separate from and selectable connectable to the axle on the mountable assembly. The portable power source can be a battery-powered, hand-portable and operable drill or rotary tool. The axle can accept the chuck of the battery powered drill or rotary tool, or otherwise be quickly and releasably connected to the drill or rotary tool. By selectively operatively engaging the chuck or rotary driving output of the drill or rotary tool to the drive axle of the drive wheel, and then selective operation of the relatively small portable tool, the user is provided manually controlled but powered rotation to the drive wheel in either direction. Such a tool can also be easily attached and detached and, thus, maximizes a small size and weight of the overall apparatus because the second component, the motive force (e.g., battery powered drill or tool) can be removed at any time from the first component, the mountable assembly with the drive wheel. This also allows the motive force (e.g. battery powered drill or tool) to be used for other purposes at the job site, or separately transported or stored. It also allows for interchangeable, different power sources. Because the power source is typically a commercially-available and conventional tool at job sites requiring duct rodding or coiled conduit winding/unwinding, this subtle feature can be beneficial.

In another aspect of the invention, an apparatus comprises a relatively small form factor mountable assembly which includes a frame that carries a rotatable drive wheel for frictionally abutting and moving duct rodding upon rotation of the drive wheel. The form factor of the mountable assembly is much smaller than a typical duct rodder itself. A releasable mount on the frame of the mountable assembly is adapted to removably fix the mountable assembly to the stand of a duct rodder or other coiled rod cage or reel. The drive wheel includes a connection adapted for removable connection to a portable rotary power source. One example is a hand drill. One example of a hand drill is a battery-powered hand drill. The drive wheel has an outer perimeter surface with a durometer and softness effective to frictionally engage typical duct rodding or conduit and propel it in the direction of rotation of the drive wheel. As such, the mountable assembly, when installed on a duct rodder or other coiled conduit stand, does not add significant size or weight, and is operable to move the duct rodding or conduit with connection to a portable rotary power source.

In another aspect of the invention, a method of power assist of unwinding and winding of a duct rodder includes mounting a small form factor, relative to the size of the duct rodder or other available power assist units, drive wheel on a duct rodder, threading duct rod of the duct rodder into engagement with the drive wheel, or between the drive wheel and pinching wheel, and operatively connecting a portable detachable power source to rotate the drive wheel. The drive wheel has a perimeter surface that frictionally engages and moves duct rodding or conduit upon rotation. The unobtrusive drive wheel can stay with the duct rodder or other coiled conduit stand, and the portable power source can be selectively connected, or disconnected for other use of the portable power source.

In another aspect of the invention, a system comprises a first component which comprises a mountable assembly with drive wheel that can be mounted to a duct rodder or other coiled conduit cage/reel and stand in a manner that allows duct rodding or conduit to be brought into abutment with drive wheel. A second component comprises a portable rotary power source that is selectable engageable with the drive wheel of the first component. Operation of the portable rotary power source allows user-control of rotation of the drive wheel. The system provides powered unwinding and winding of duct rod or other conduit in an overall size and weight that is not much bigger than the duct rodder or other coiled conduit reel and stand, plus allows the use of a hand-sized, hand portable removable power source that can be used for other purposes at a job site.

These and other objects, features, aspects, and advantages of the invention will become more apparent with reference to the accompanying disclosures.

BRIEF DESCRIPTION OF THE DRAWINGS

FIGS. 14A-E are illustrations and data regarding an exemplary drive wheel that can be used with embodiments of the invention.

DETAILED DESCRIPTION OF EXEMPLARY EMBODIMENTS

A. Overview

For a better understanding of the invention, examples of how to make and use the invention are now described in detail. It is to be understood these are for example only and neither inclusive nor exclusive of all forms and embodiments the invention can take.

Figure 1A:
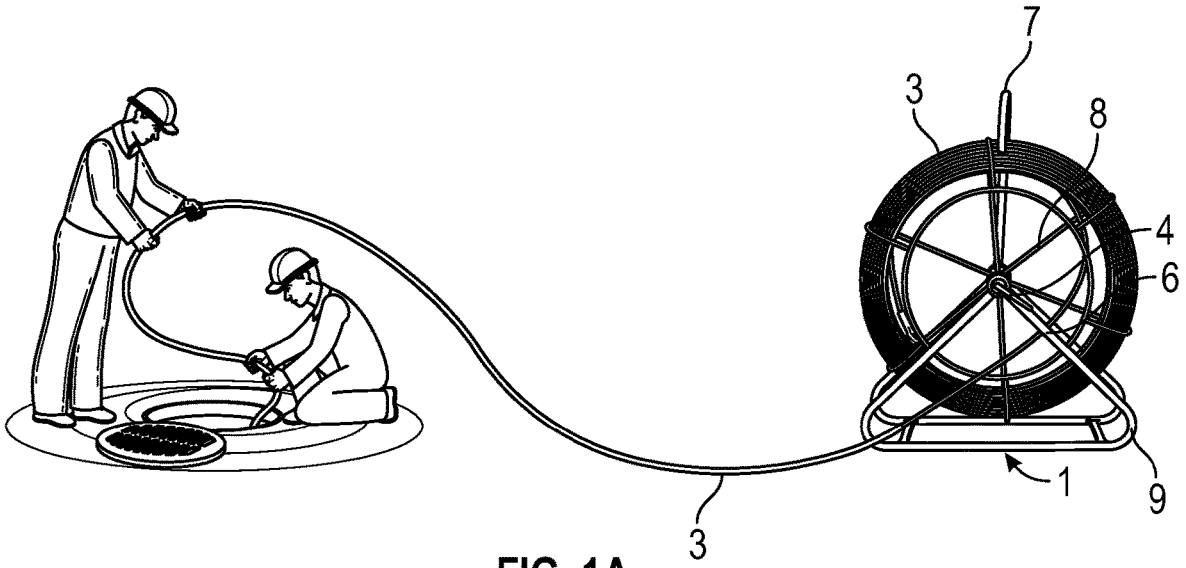
FIG. 1A (Prior Art)
FIGS. 1A-1E-illustrate a typical duct rodder with hand-pulled duct rod and how it is utilized in practice.
Figure 1B:
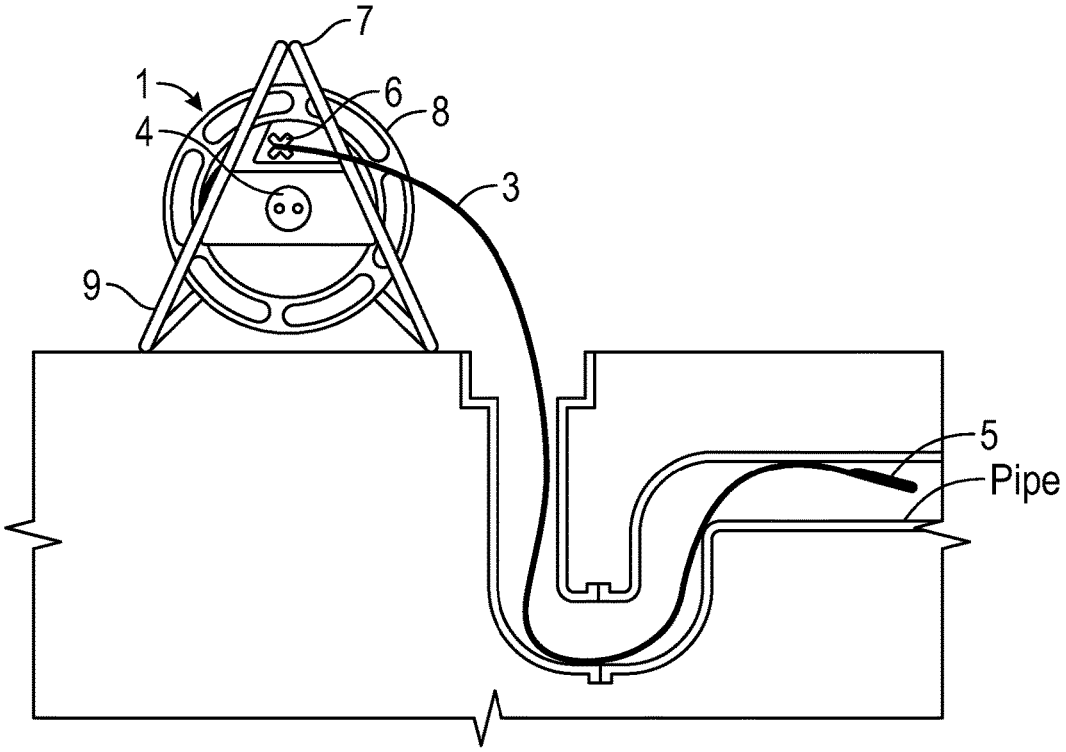
FIG. 1B (Prior Art)
Figure 1C:
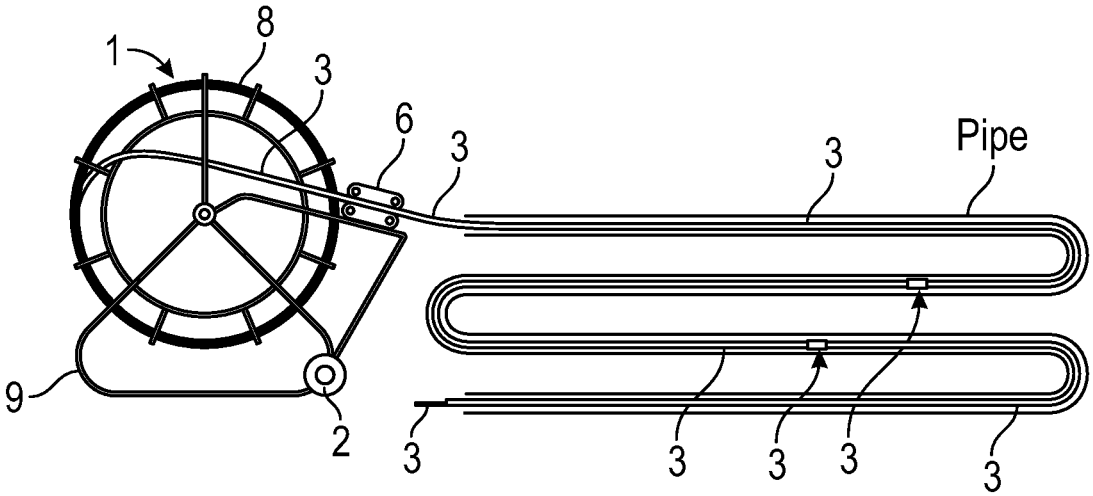
FIG. 1C (Prior Art)
Figure 1D:
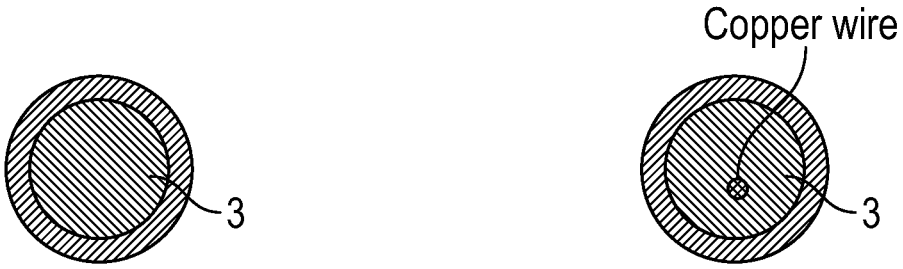
FIG. 1D (Prior Art)
Figure 1E:
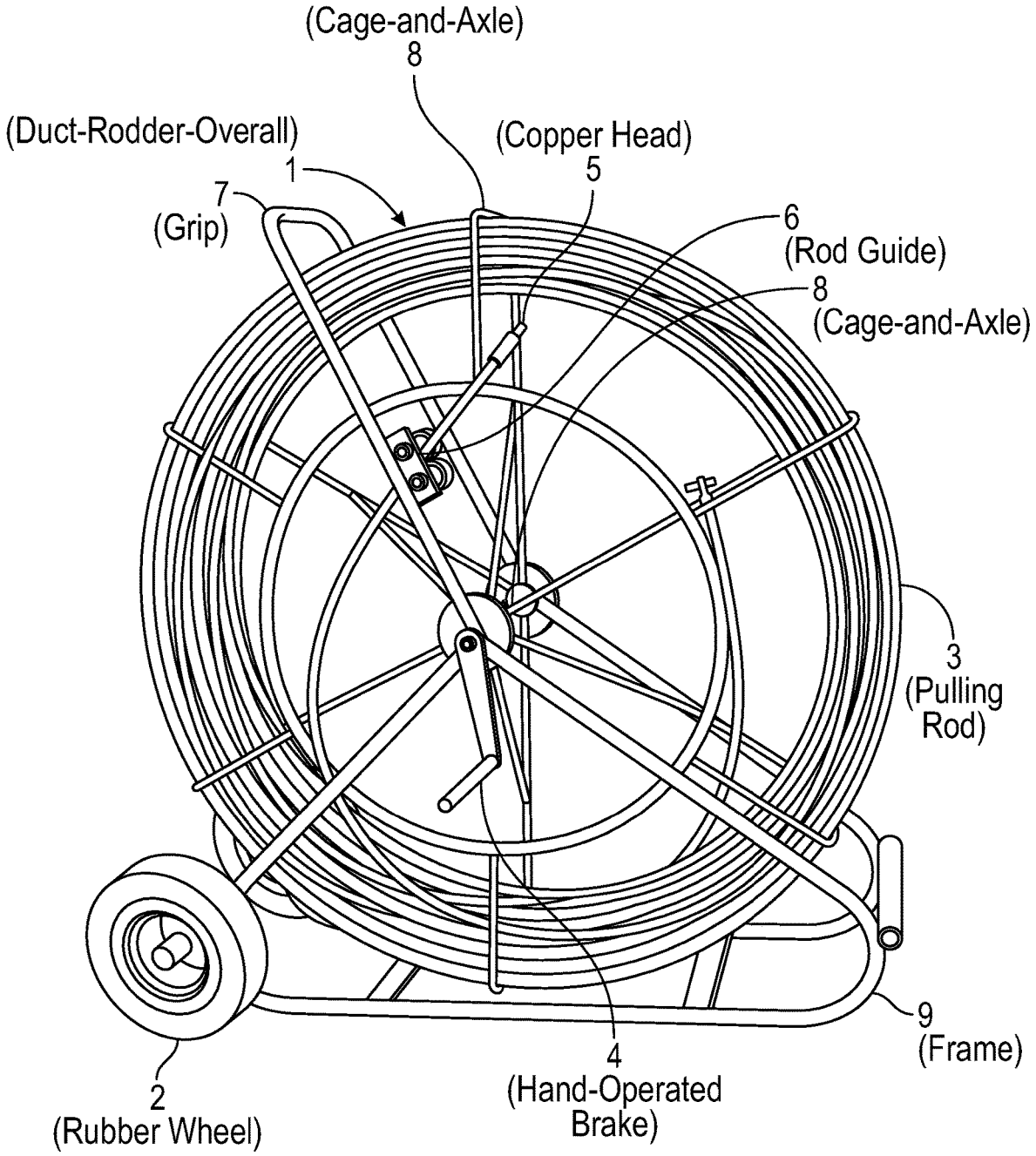
FIG. 1E (Prior Art)

It is to be understood that the exemplary embodiment uses a commercially-available duct rodder 1 such as that of FIG. 1E, but adds a unit 100 to it to facilitate powered unwinding and winding of the duct rod 3 from that duct rodder unit 1 with a separable portable rotary power source 108. As will be appreciated, this embodiment of the invention could be included as original equipment to a duct rodder. As will be appreciated by those skilled in the art, this embodiment of the invention can be applied in analogous ways to other coiled conduit.

As will also be appreciated, the exemplary embodiment focuses on a duct rodder of the type that has a copper head 5 of FIG. 1E and/or copper internal longitudinal wire of the type of FIG. 1D for purposes of threading the duct rod through an interior bore of a pipe, trench, channel, tunnel, or the like, to assist in locating portions of that run. The invention can be applied, alternatively, to other coiled, elongated rod, cable, wire, or other material the needs to be unwound or wound from a coiled state.

B. Apparatus and Operation of First Exemplary Embodiment

1. Structure

With specific reference to FIGS. 3A-E, as well as isolated portions from them in FIGS. 4-8 and subparts A and B for each, an exemplary embodiment of a mountable assembly or unit 100 apparatus according to the invention includes a plate frame 102 having a mounting end 104 and an opposite end 105. A drill side 106 is opposite side 107 (see FIG. 6B). As shown in some of these figures, a typical commercially-available battery-powered drill 108 can be attached by hands 202 of a single worker/user 200 at its chuck to a rotatable drive wheel 120 on mountable assembly 100 for unwinding or winding, as discussed below. Drill 108 is shown operatively attached from mountable assembly 100 (its chuck tightened to the rotatable axle of the drive wheel 120 extending from the drill side 106 of plate frame 102 in FIG. 3A. Drill 108 is shown removed from mountable assembly 100 in FIG. 3B. The relatively small form factor of mountable assembly 100 relative to the overall duct rodder 1 can be seem, and how plate frame 102 of exemplary embodiment mountable assembly 100 can be along and close to one side of the cage/reel 8 of duct rodder 1, and not extend outside the diameter of the cage/reel 8 of duct rodder 1 or much away from that side of duct rodder 1 when drill 108 is not attached. Thus, duct rodder 1 can be transported, stored, and operated in basically the same ways as a duct rodder 1 without a mountable assembly 100.

It will also be appreciated that embodiment 100 can be transported and installed by arm(s) 201 and hand(s) 202 of a single worker 200. It can be clamped or otherwise removably attached to stand of duct rodder 1, which usually has structural members that are robust enough to hold a clamped or bolted assembly 100 as well as a cage or reel 8 loaded with duct rodding 3. Assembly 100 can also be made of materials robust enough for the forces it will typically experience in use or transport. In this embodiment, plate frame 102 is made of metal plate (e.g. steel plate). Other materials with sufficient strength and rigidity are possible.

Figure 3A:
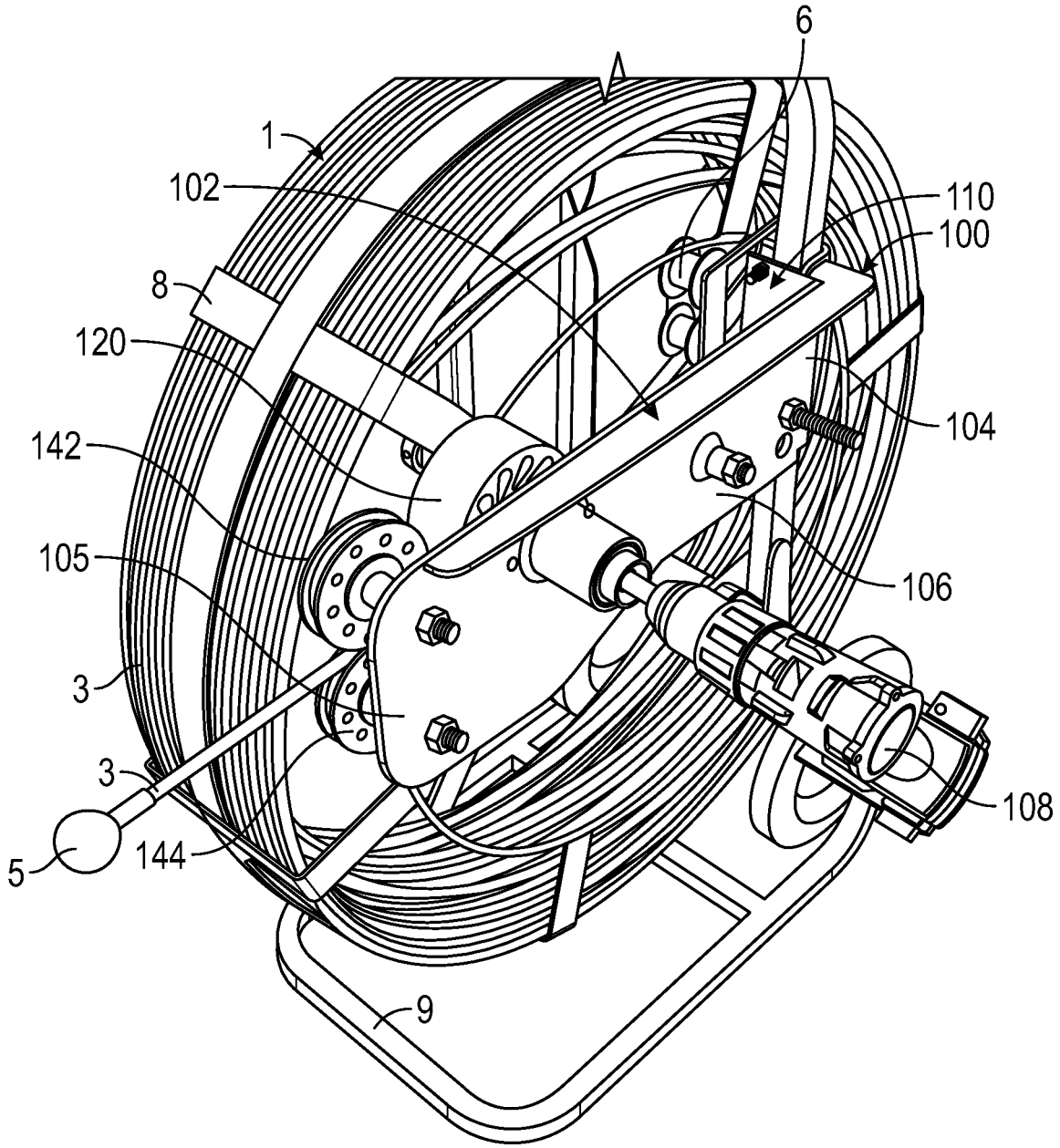
FIGS. 3A-E are pictures of an exemplary embodiment of a powered according to the present invention.
Figure 3B:
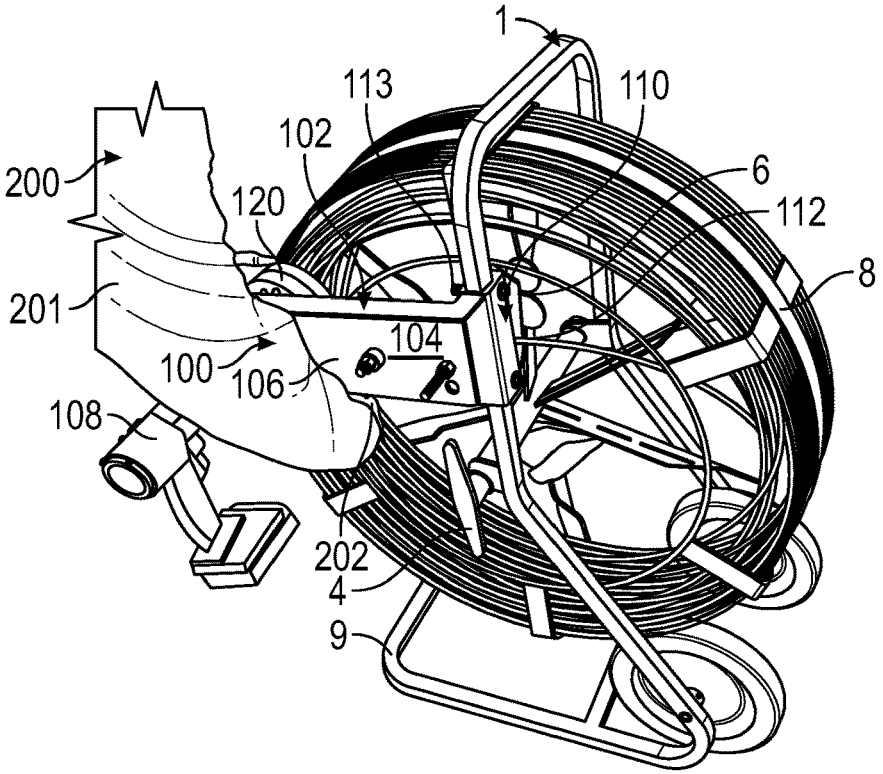
Figure 3C:
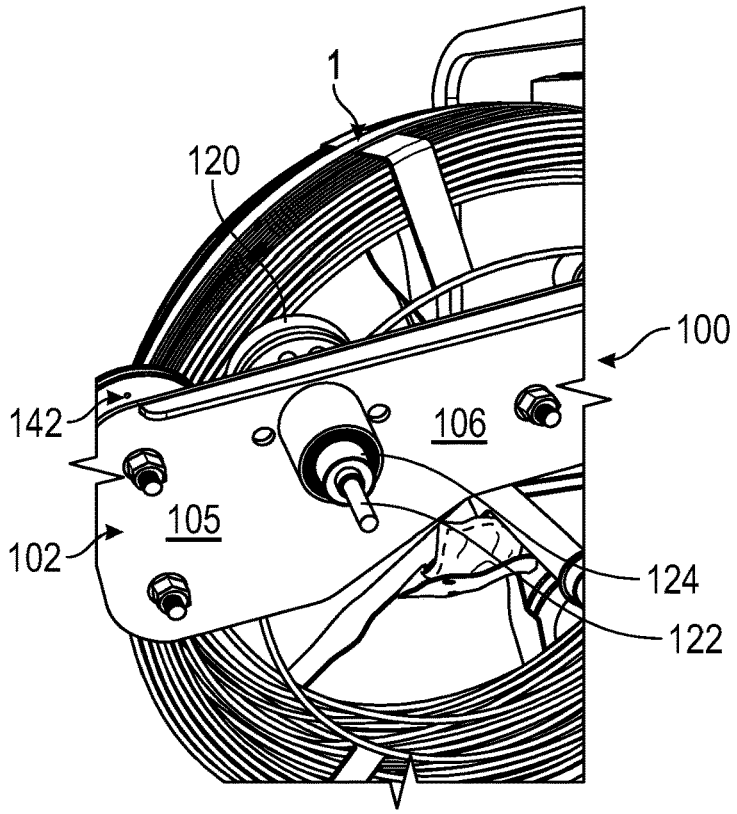
Figure 3D:
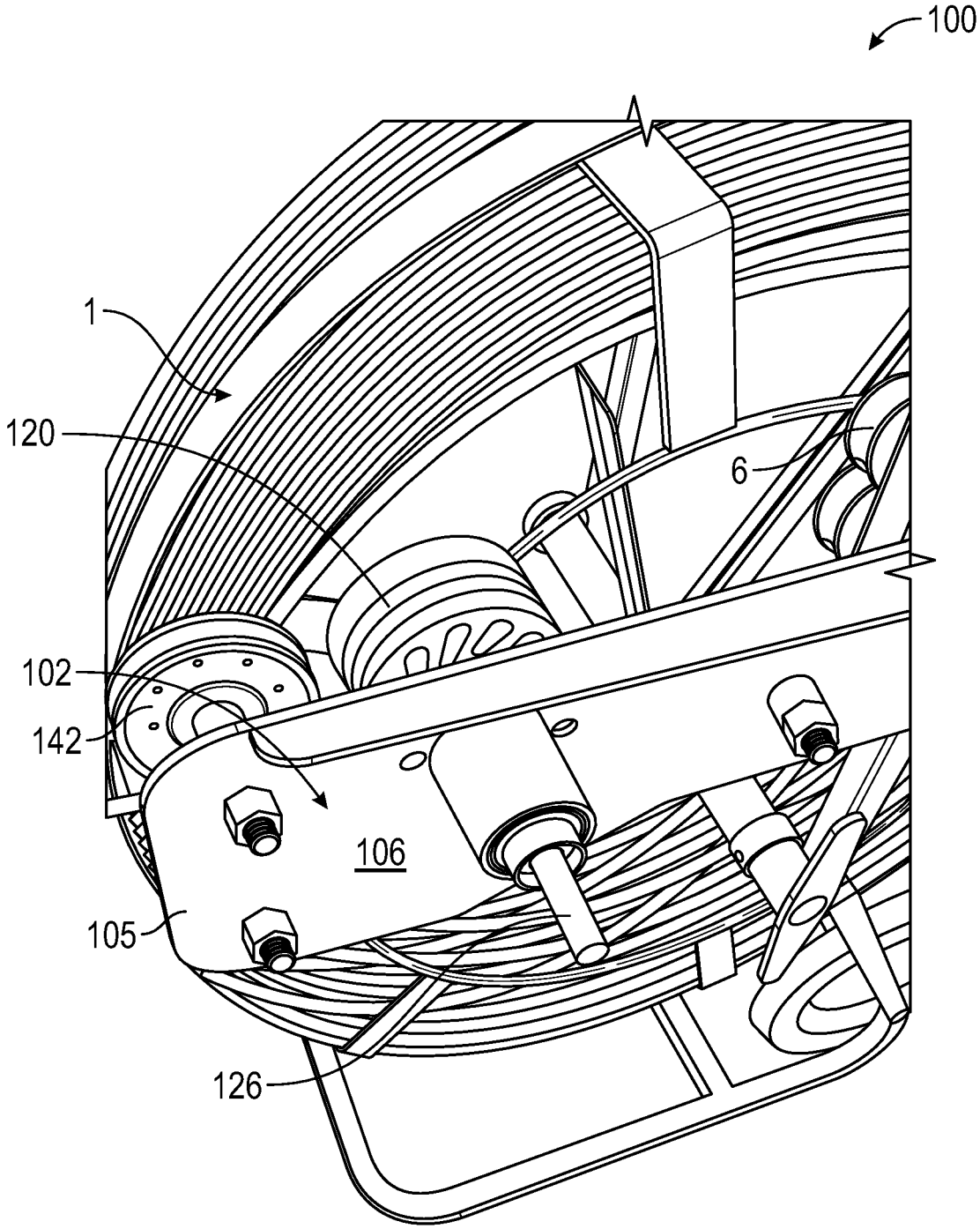
Figure 3E:
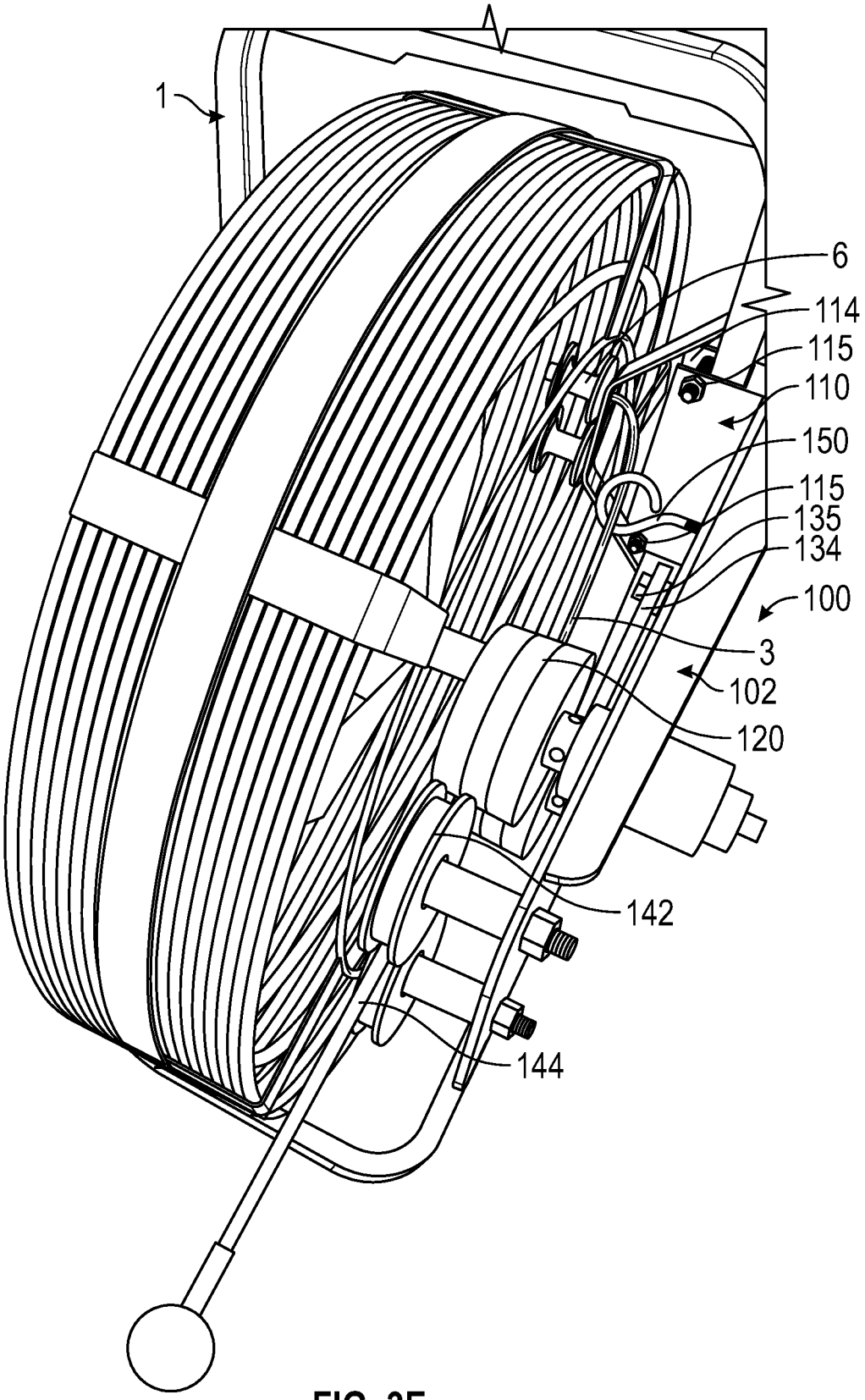
Figure 4A:
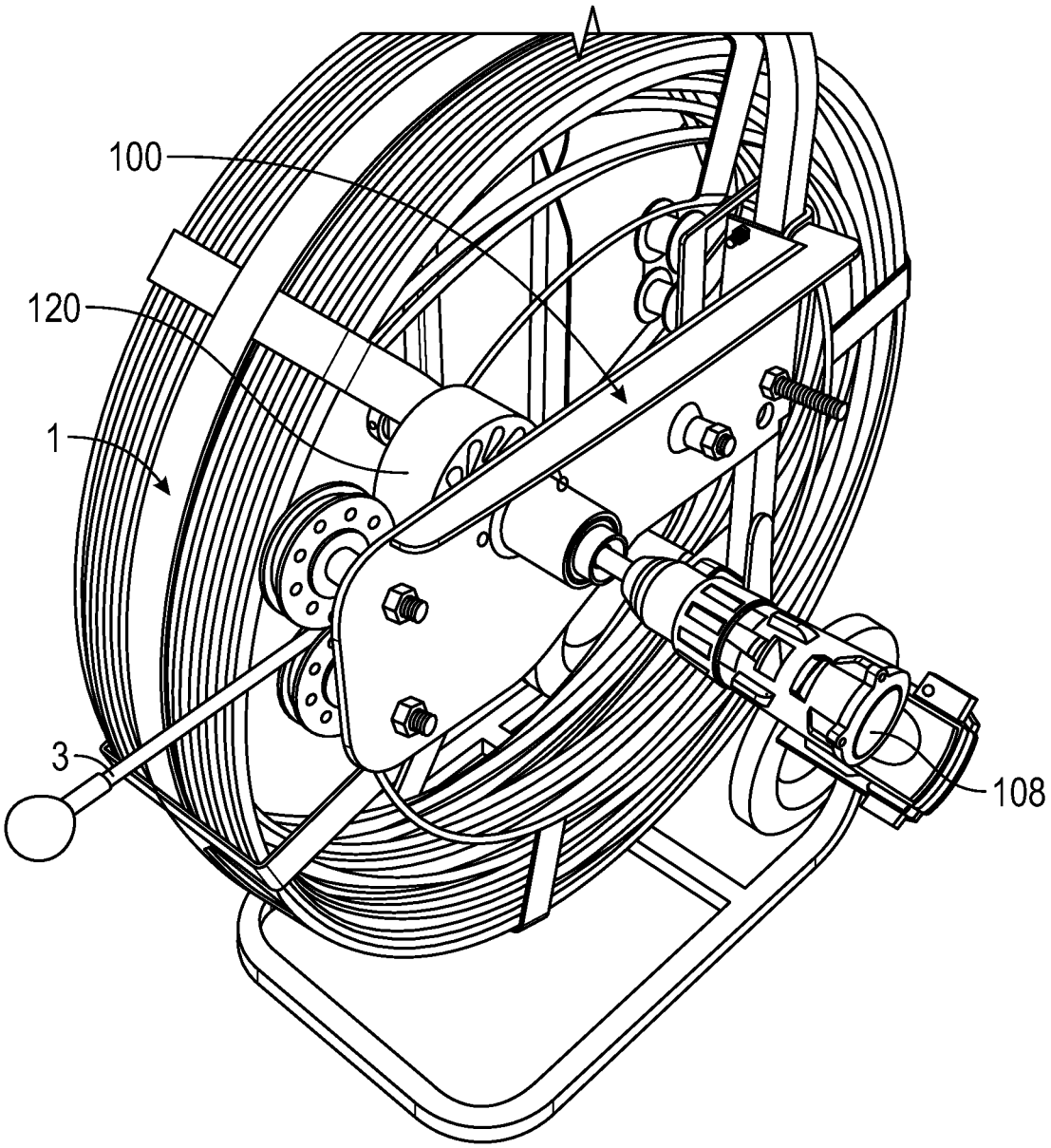
FIGS. 4A and B, 5A and B, 6A and B, 7A and B, and 8A and B are isolated views from FIGS. 3A-E.
Figure 4B:
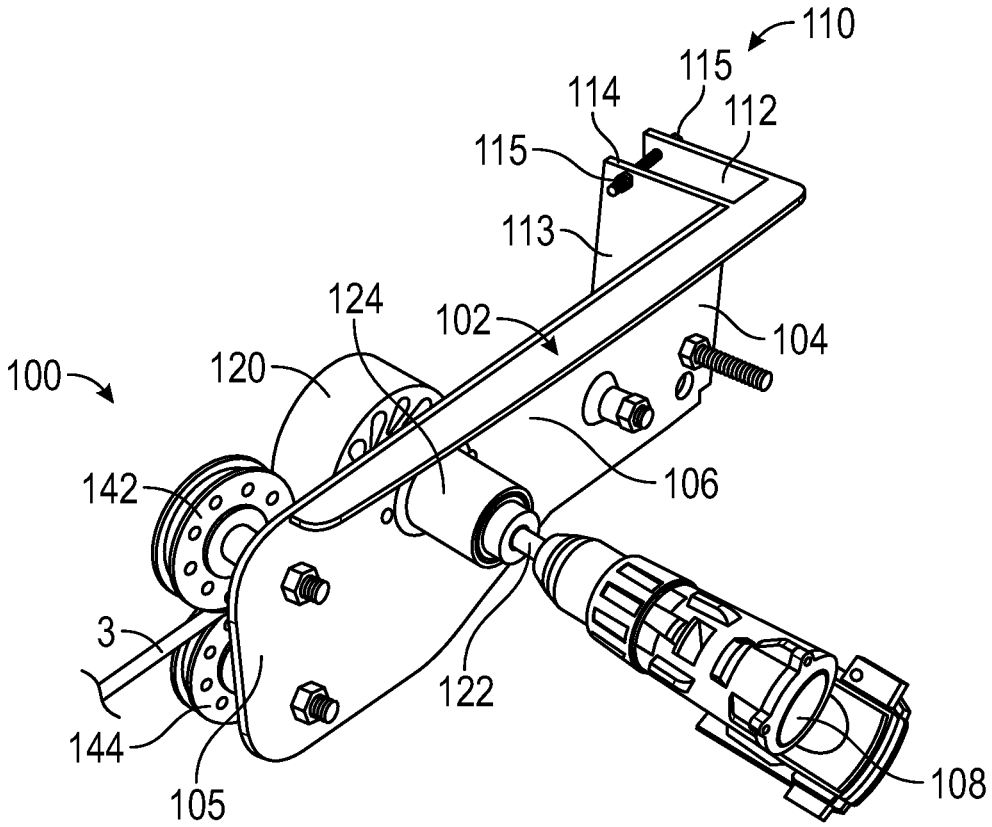
Figure 5A:
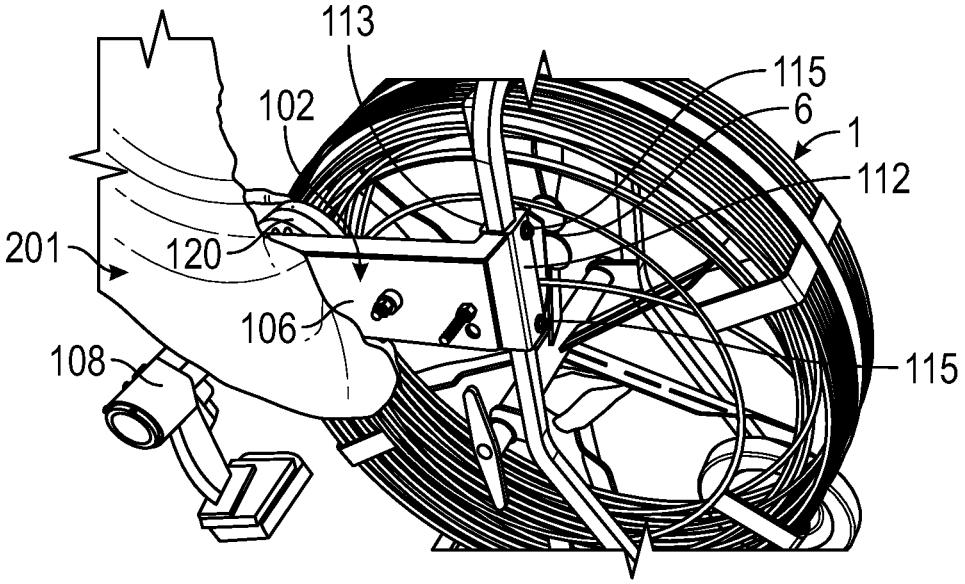
Figure 5B:
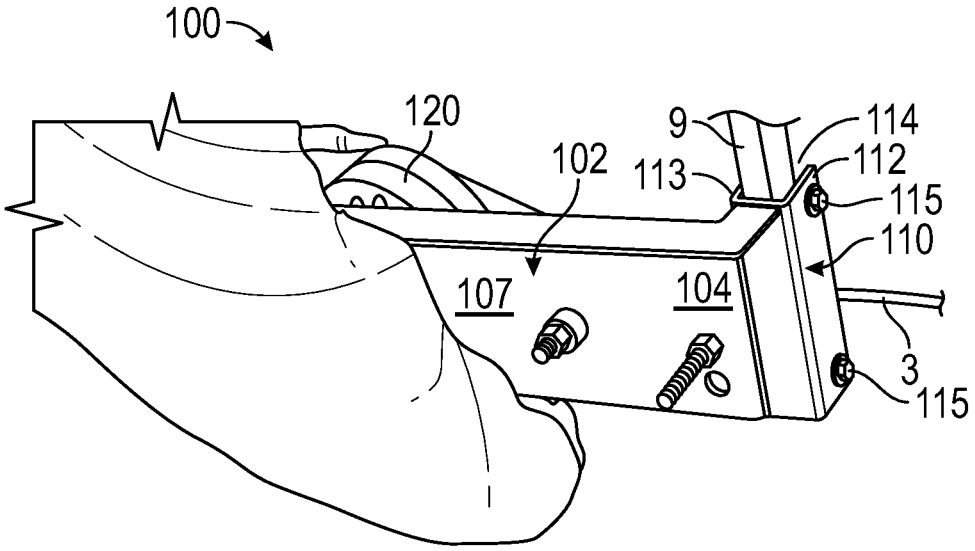
Figure 6A:
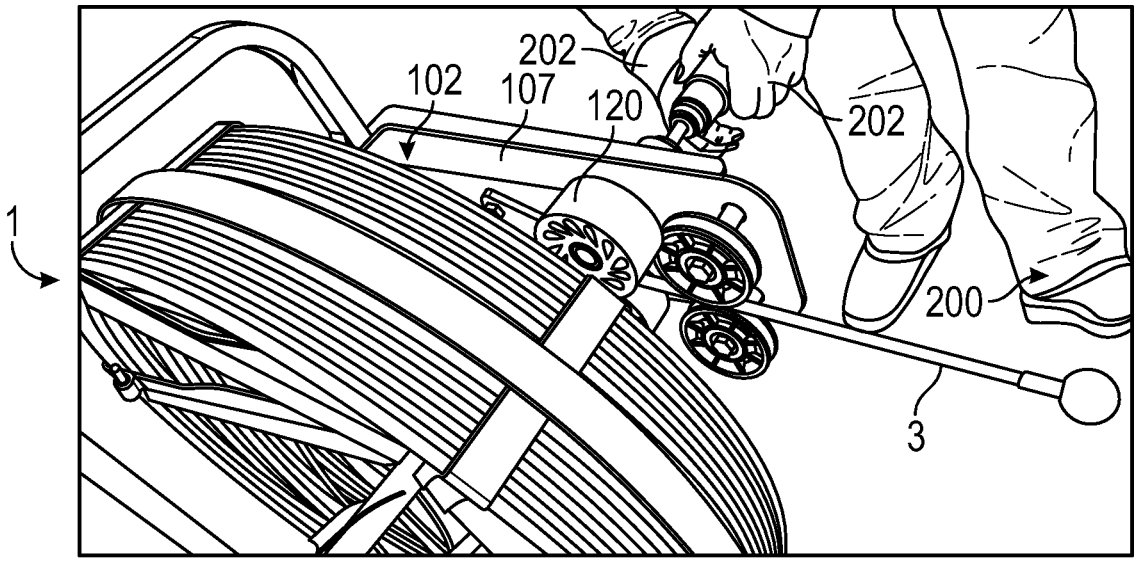
Figure 6B:
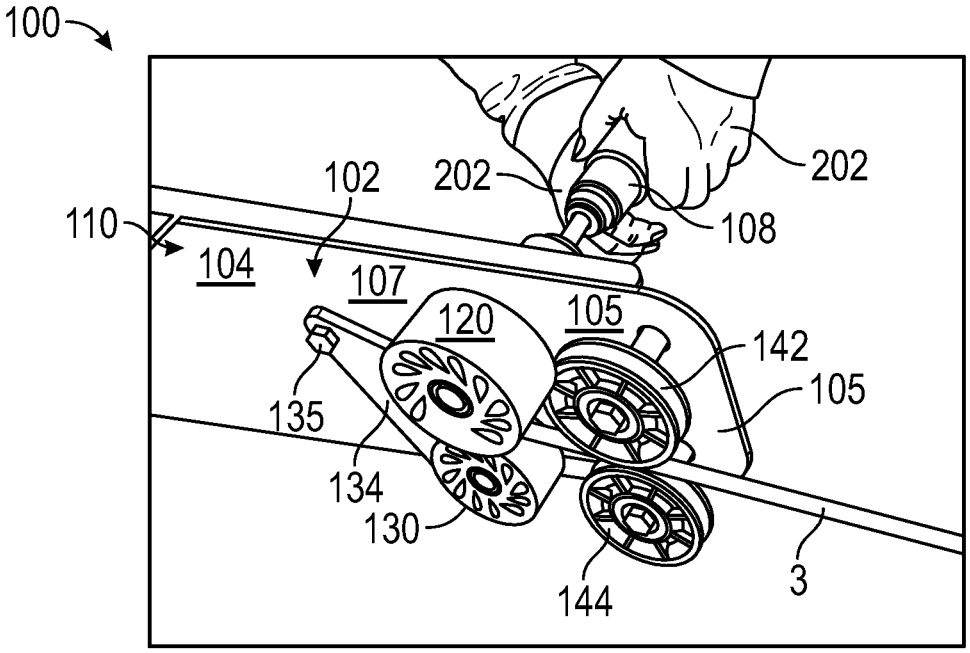
Figure 7A:
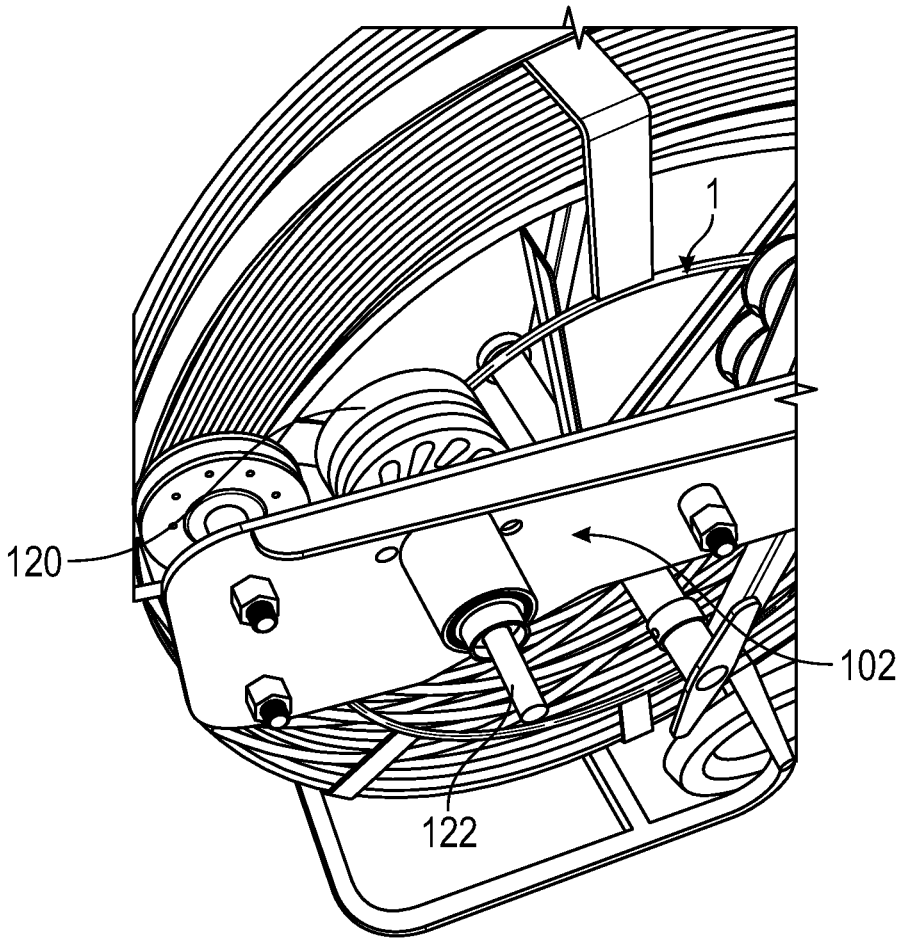
Figure 7B:
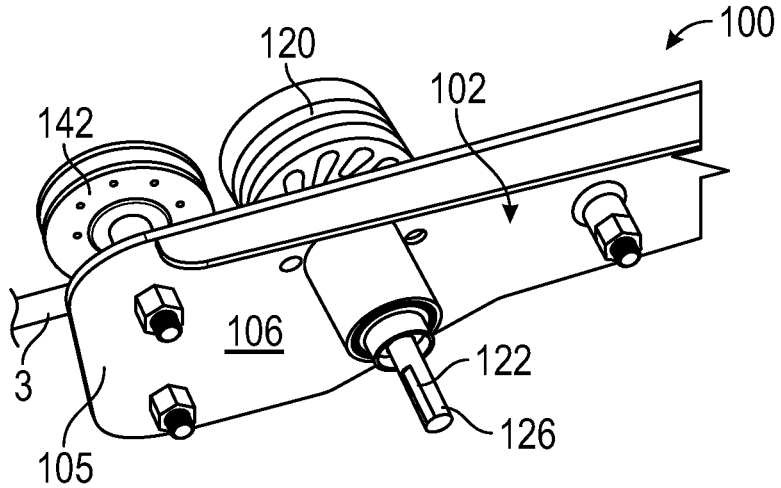
Figure 8A:
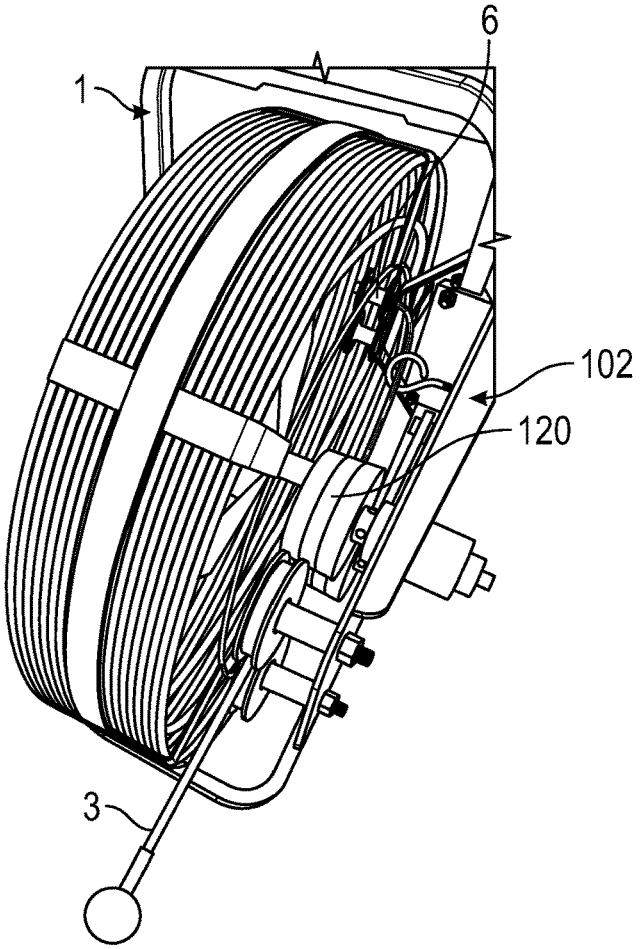
Figure 8B:
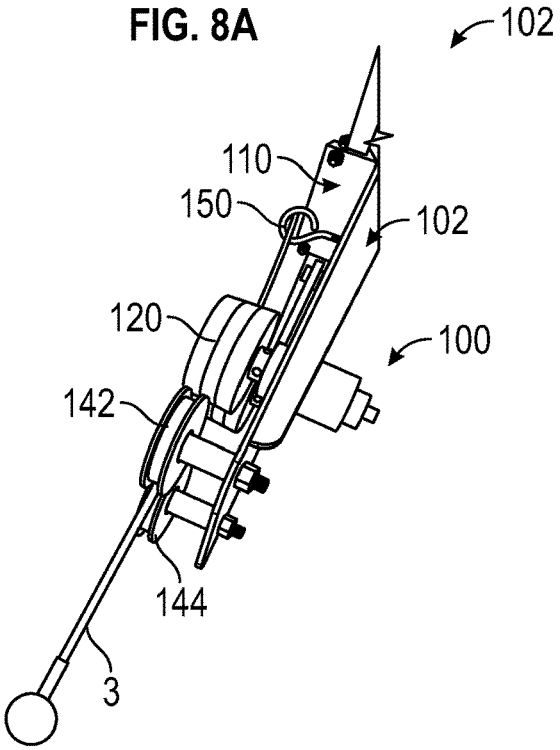

In this embodiment 100, a clamp-type mount 110 at end 104 of plate frame 102 can be simply two parallel plates 112 and 113 defining an open space 114 between. The distal ends of those plates 112 and 113, which are essentially extending transversely from side 107 of plate frame 102, can receive a portion of the stand 9 of a commercially available duct rodder 1 such as FIG. 1E, as well as other typical duct rodders. Bolts 115 can be tightened down to clamp assembly 100 to duct rodder frame 1 in a position that the exit end 105 extends in a direction typical for unwinding and winding of duct rodding 3, and the plate frame 102 is spaced from the cage/reel 8 of the duct rodder 1 so that cage/reel 8 can freely rotate without interferences, as illustrated in FIG. 3A. Other techniques for removably mountable assembly 100 to a duct rodder 1 are possible so long as they allow the components of side 107 of assembly 100 to operate, do not interfere with rotation of cage/reel 108 of duct rodder 1, and allow the duct rodding 3 to be operatively positioned relative to assembly 100 (e.g. unwind and wind from and to cage/reel 108).

A drive wheel 120 is operatively mounted on side 107 of plate frame 107 to an axle 122 that extends from side 106 through plate frame 102. See FIG. 3C. A bushing 124 can help support axle 122 but allow it to rotate at low friction but at high speed. The distal exposed end 126 of axle 122 on drill side 106 of plate frame 102 receives the chuck of drill 108. It can be cylindrical (with or without one or more flattened portions), or it could have facets such as hex, a square, or other for more robust gripping by drill 108.

Figure 2A:
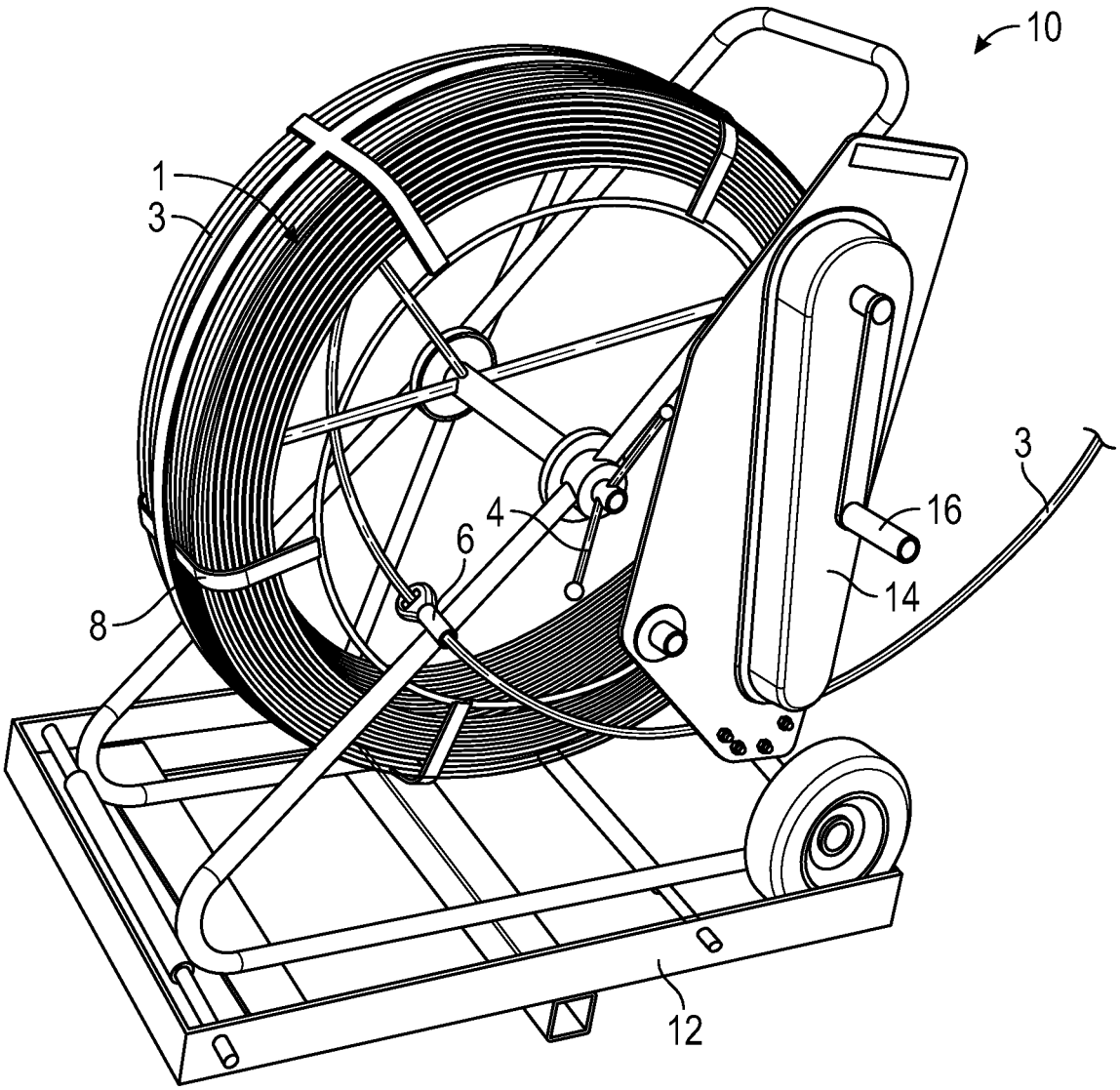
FIG. 2A (Prior Art)
FIGS. 2A-C illustrate attempts to improve mechanical efficiencies of unwinding and winding of duct rodders such as FIG. 1A.
Figure 2B:
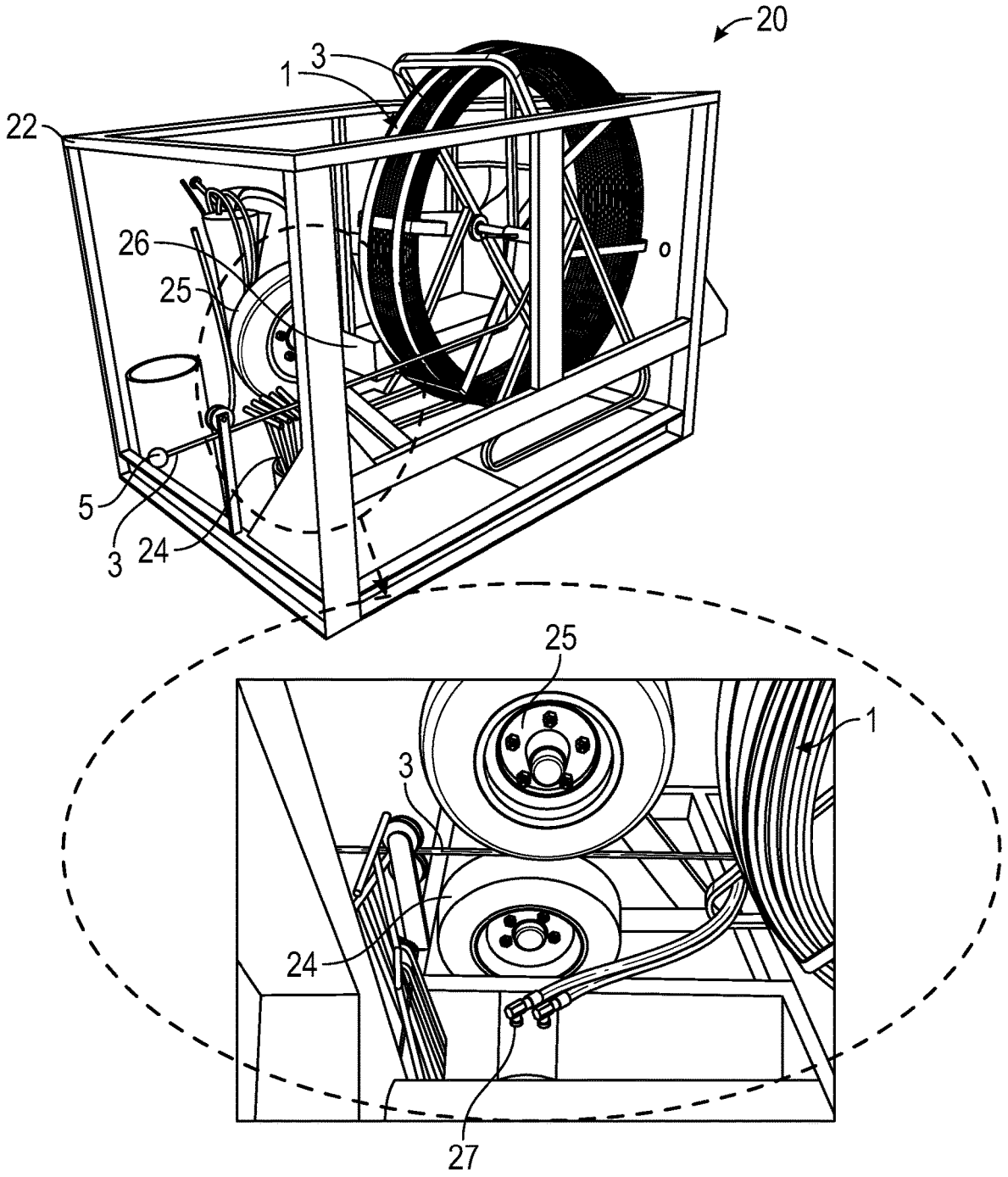
FIG. 2B (Prior Art)
Figure 2C:
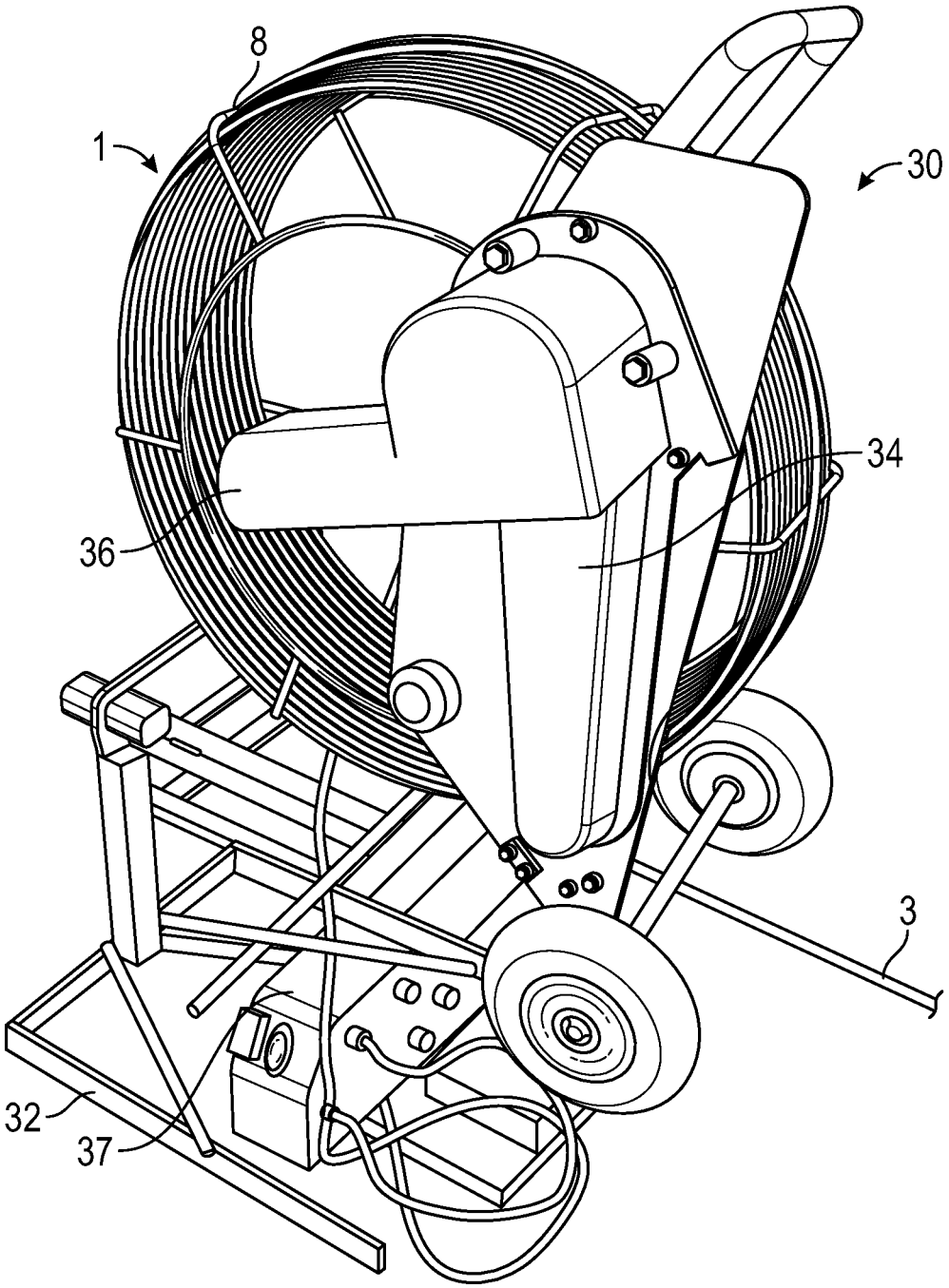
FIG. 2C (PRIOR ART)

In this embodiment, one example of drive wheel 120 is available from McMaster.com under part number 2497K15. A specification sheet is at FIGS. 14A-E. The inventor discovered that this size, width, and material characteristics were much more effective at gripping and advancing for unwinding or winding typical fiberglass duct rod 3 than hard rubber non-pneumatic wheels, or even pneumatic wheels such as shown in FIG. 2C. The invention is not necessarily limited to that particular wheel, however. FIGS. 14A-E and FIG. 9 provides details about the particulars of this specific drive wheel.

Figure 9:
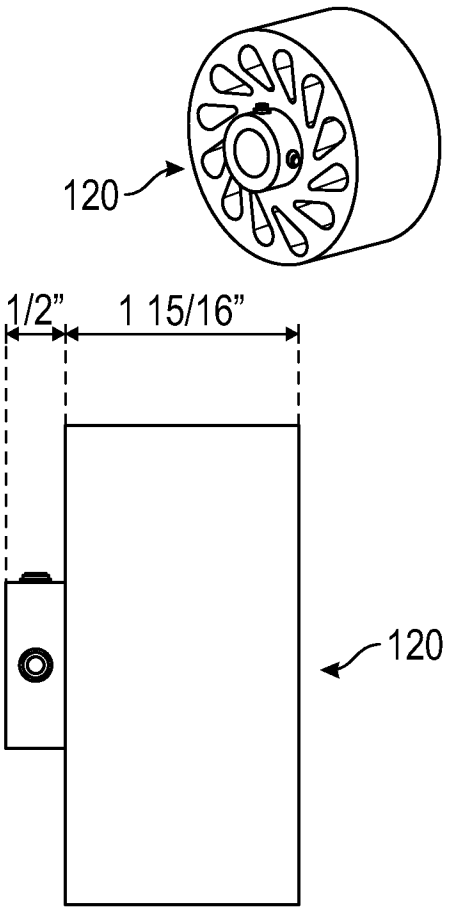
FIG. 9 illustrates one example of a drive wheel that can be used in embodiments of the invention.
Figure 9:
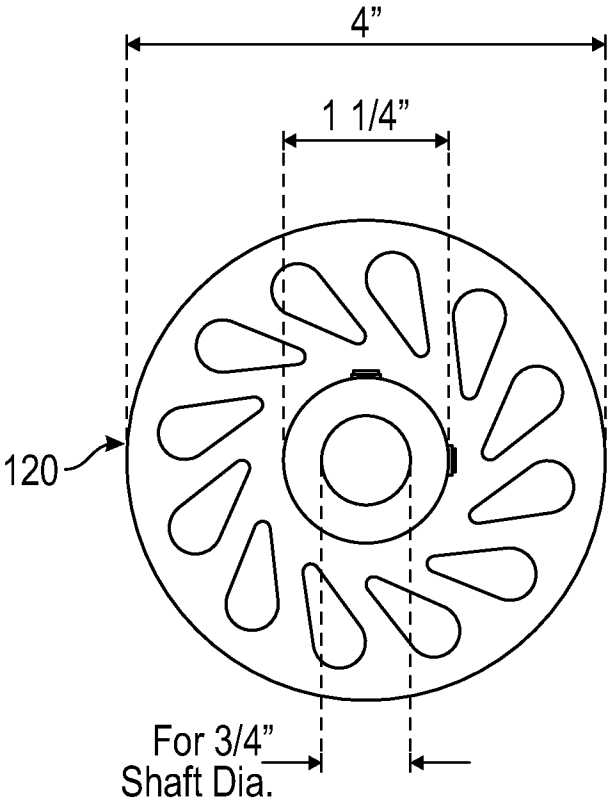

For example, as can be seen at FIG. 9, this type of wheel is not solid but is neoprene (polychloroprene) with spaced apart, tear-drop shaped through openings between opposite wheel sides that are all at a similar or same oblique angle to the wheel rotational axis. A center axially opening includes a tapped hub of steel with two radial set screws that can fix the wheel to a shaft or stud such as drive axle 122 discussed above. The soft surface (35A durometer) and the tear-drop oblique openings allows the wheel to gently grab and maintain contact as it is compressed to prevent slippage of a variety of materials, including fiberglass rodding. The outer surface of fiberglass duct rodding can be fiberglass or some coating (non-limiting examples include paint or PVC). Neoprene can give effective gripping of these and other surfaces including metal and plastics. Oil-resistant neoprene is a synthetic rubber generally stronger and harder than natural rubber and more resistant to water, oils, and solvents, and retains its properties over a temperature range from well-below freezing to well-above one hundred degrees F. This example has a diameter of four inches and a width at perimeter surface of close to two inches. This width accommodates the diameters of typical duct rodding, which can range from around 18¼ inch to ¾ inch. The hub has an inside diameter of ¾ inch which thus is complementary to a wide variety of battery-powered drills or drivers.

As can be seen from FIGS. 14A-E, wheel 120 can be commercially purchased with the foregoing properties in different form factors and durometers according to need or desire.

2. Operation

Figure 10A:
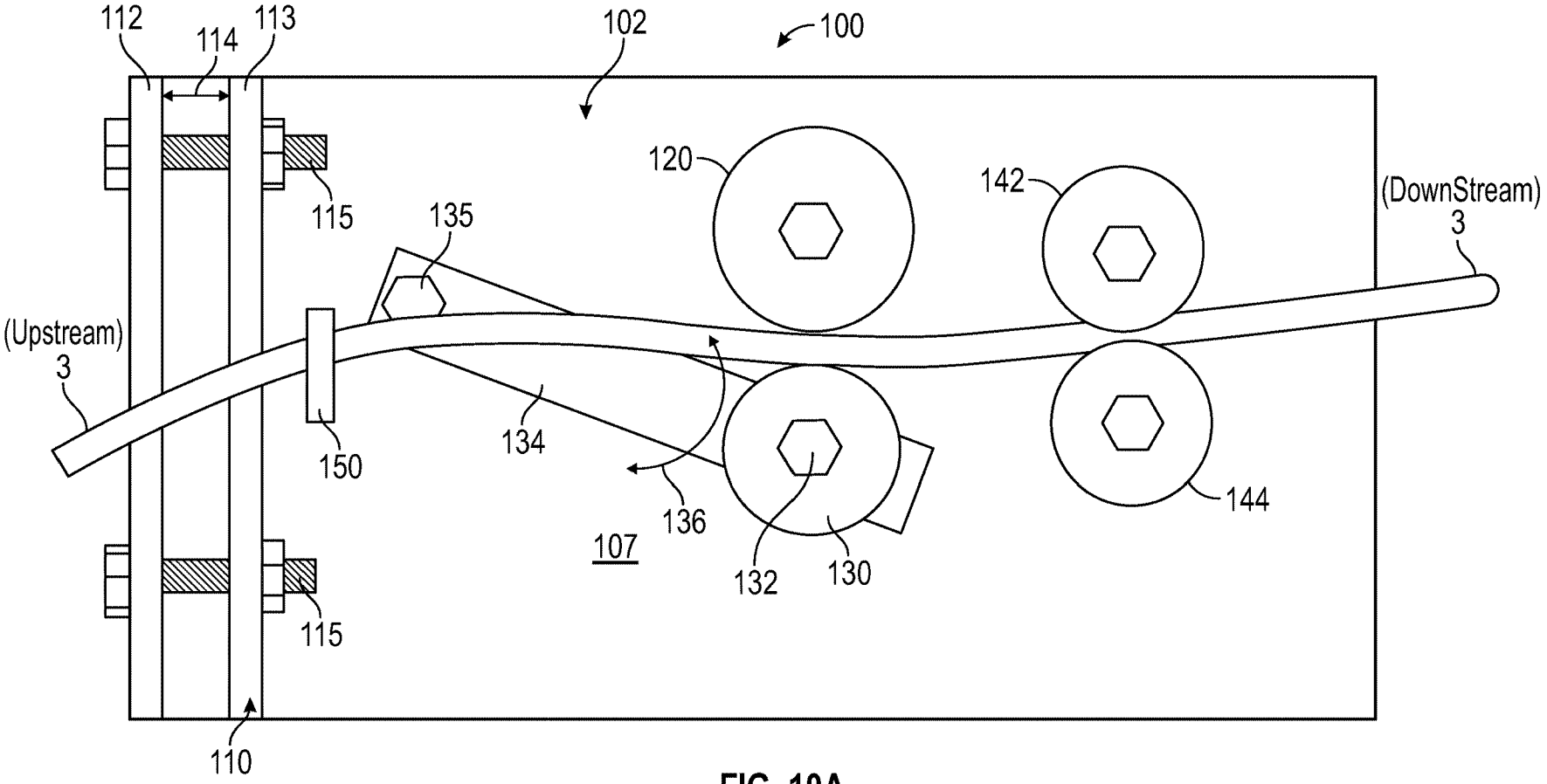
FIGS. 10A-B are diagrammatic depictions of the exemplary embodiment of FIGS. 3A-E, including showing its operation (how the duct rodding is threaded through the device) and adjustability of the pinching wheel relative the drive wheel for the exemplary embodiment.

Operation of mountable assembly 100 discussed above is as follows. As illustrated at FIGS. 10A and B, a pinching wheel 130 is disposed under drive wheel 120 on the free end of a pivot arm 134 bolted to plate frame 102 at bolt 135. In this example, pinch wheel 130 is underneath drive wheel 120. By loosening bolt 135 slightly, swinging arm 134 can be swung down around the axis of bolt 135 (see downward direction of arrow 136) sufficiently to allow the diameter of duct rodding 3 to be easily threaded between, or inserted sideways between, drive wheel 120 and pinching wheel 130. By then swinging arm 134 upward along arc 136 of FIG. 10A until pinching wheel 130 comes into contact with the lower side of duct rodding 3 and brings the upper side of duct rodding 3 into abutment with the lower side of drive wheel 120, and then tightening bolt 135 sufficiently to hold arm 134 in that position, the pinching force of pinching wheel 130 one side of rodding 3, and the drive wheel 120 on the other side of rodding 3, promotes sufficient friction of rodding 3 and drive wheel 120 to move rodding 3 in the direction of rotation of drive wheel 120. See, e.g., FIG. 3B, which shows how a single user 200 with a wrench can reach under and around unit 100 when mounted on duct rodder 1, loosen bolt 135, rotate arm 134 up until pinches rodding 3 to the underside of drive wheel 120, and then re-tighten bolt 135. Bolt 135 can either be in a tapped aperture in plate 102 or simply have a welded or free nut on the opposite side of plate 102 to allow bolt 135 to be tightened to clamp arm 134 against side of plate assembly 102. Bolt 135 can be tightened or loosened with a common wrench quickly and easily. Once the duct rod 3 is positioned between drive wheel 120 and pinching wheel 130, the pinching force against drive wheel 120 can be adjusted according to need or desire. Pinch wheel 130 is rotatable on bolt 132 which is fixed to arm 134. This combination allows user adjustability for best performance of unwinding and winding, different sizes and materials of duct rodding 3, and other variables such as weather conditions or the like.

For example, as discussed above, for a drive wheel 120 made of neoprene with tear-drop oblique openings as shown in FIG. 9, pinching wheel 130 can be moved up against rodding 3 and drive wheel 120 with sufficient manual force to not only bring all three into abutment but compress drive wheel 120 at least some. By then tightening bolt 135 to fix arm 134 at least generally in that position, there can be added grabbing and maintaining contact of drive wheel 120 as it is compressed to prevent slippage of rodding 3 during rotation of drive wheel 120. By empirical techniques, including trial and error, the best pinching pressure for a given application can be fine-tuned by the user by this simple loosening of bolt 135, selecting the amount of upward swinging of arm 134 for a given pinching pressure, and a quick tightening of bolt 135. Optionally, materials other than neoprene that have some elasticity and resiliency, could be used. They could optionally include openings through the sidewalls to provide some additional compressibility of drive wheel 120 when brought into abutment with duct rodding and/or a pincher wheel or other mechanical backstop opposite the duct rodding or conduit. The number, form factor, size, and orientation of those openings could vary.

Pinching wheel 130 can be made of a variety of materials, including that of drive wheel 120 or other materials so long as it can exert sufficient up-pressure on duct rodding 3 to pinch duct rodding against the underside of drive wheel 120 to allow the gripping force of drive wheel 120 to move the duct rodding 3 out from reel 1 or back into reel 1. As such, pinching wheel May be of a solid natural or synthetic rubber, or a plastic or metal or other material. As will be appreciated by those skilled in this technical area, the amount of pinching force of pincher wheel 130 can be adjusted by the user/operator according to need or desire. Sometimes more pinching force is needed for effective grip and unreeling or reeling in of duct rodding 3; sometimes less is needed. This can depend on a number of factors including but not limited to the length of the duct rodding to by unreeled or reeled in, the diameter and material of the duct rodding 3, the resistance of the reel 1 to rotation, the weather conditions (which can affect slipperiness of the exterior of the duct rodding 3 or resistance to rotation of the reel with the duct rodding).

As will be appreciated by those skilled in the art, alternatives to pincher wheel 130 are possible, as are use without a pincher wheel 130 or similar. For example, simply a mechanical stop member (e.g. a flat or rounded metal member), instead of a rotating wheel 130, could be on arm 134, and converged towards drive wheel 120 to pinch rodding or conduit 3 against drive wheel 120. That stop member could be a surface of the arm 134 itself. The surface could be made low friction by the nature of the surface (e.g. polished metal) or by some low-friction coating. Still further, instead of a pivoting arm 134, adjustable convergence of some type of pinching member (wheel 130 or some mechanical stop) could be achieving by other structure. One non-limiting example would be a sliding member that could be slid towards and away from drive wheel 120 and fixed into any position along that path. One example could be a slot (linear or curved) machined into plate 102 and the pinching member carried on a bolt that can be loosened or tightened to move, when loosened, the bolt in the slot towards or away from drive wheel 120 and fix it in position, when the bolt is sufficiently tightened. Other techniques are possible.

Additionally, the pinching component, whether arm and wheel 134/130 or otherwise, could be above drive wheel 120, and be adjustable towards and away from the top of drive wheel 120, with rodding or conduit 3 positioned over the top of drive wheel 120.

Also, drive wheel 120 might be adjustable towards and away from a fixed pincher wheel 130 or other pinching structure. It could be on a pivoting arm like arm 134 or otherwise adjustable and fixable into a final operating position.

Still further, another embodiment of the mountable assembly 100 could just have drive wheel 120 and not use any pincher wheel 130. The conduit could be threaded over the top of drive wheel 120 and gravity help frictional contact between the two. Drive wheel might include larger diameter edges than its middle to help retain rodding or conduit 3 in place. They could be separate plates sandwiched on opposite sides of a cylindrical drive wheel 120, or built into wheel 120.

As will be appreciated, at a minimum, the mountable assembly 100 has the ability to mount to a stand of a duct rodder or other coiled conduit stand, and include a drive wheel effective to engage and unwind from or wind to the duct rodding or conduit from its cage or reel by friction between the drive wheel and the rodding or conduit, where an interface provides the ability for powered rotation of the drive wheel by a portable rotary tool, such as a drill or driver. As will be appreciated, in its most basic form, that interface could allow any of a variety of rotary tools to be used, including battery powered tools but also corded tools that could be plugged into an available electrical power source. There could be electrical generators available. Recently, many motor vehicles include on-board plug-in DC or AC electrical power out (either from vehicle batteries or on-board electrical converters or generators. However, as will be appreciated by those skilled in the art, it can be very beneficial to use a portable, hand-operated battery-powered, conventional rotary drive unit like a drill or driver.

In this embodiment, two guide wheels 142 and 144 are downstream from drive wheel 120 and pincher wheel 130. As indicated, wheels 142 and 144 have grooves 143 and 145 respectively that can ensure guidance of duct rod 3 therebetween. Both wheels are rotatable on bolts or axles that are attached to plate frame 102. These are not required but can improve smoothness of operation.

In this embodiment, on the upstream side from drive wheel 120, a guide 150 for duct rod is bolted to a plate frame 102. In this example guide 150 is simply an eye-bolt. This helps facilitate feeding of duct rod 3 to drive wheel 120 and pincher wheel 130. Obviously, other guides that provide a feeding guide to drive wheel 120 is possible. Such a guide is not required but can be beneficial.

The material for plate frame 102 can vary. In this example, it is steel. In this example, a supporting member along its top edge at right angles to the longitudinal axis of the plate provides additional robustness.

Guide wheels 142 and 144 can be metal, plastic, or other materials.

Figure 11:
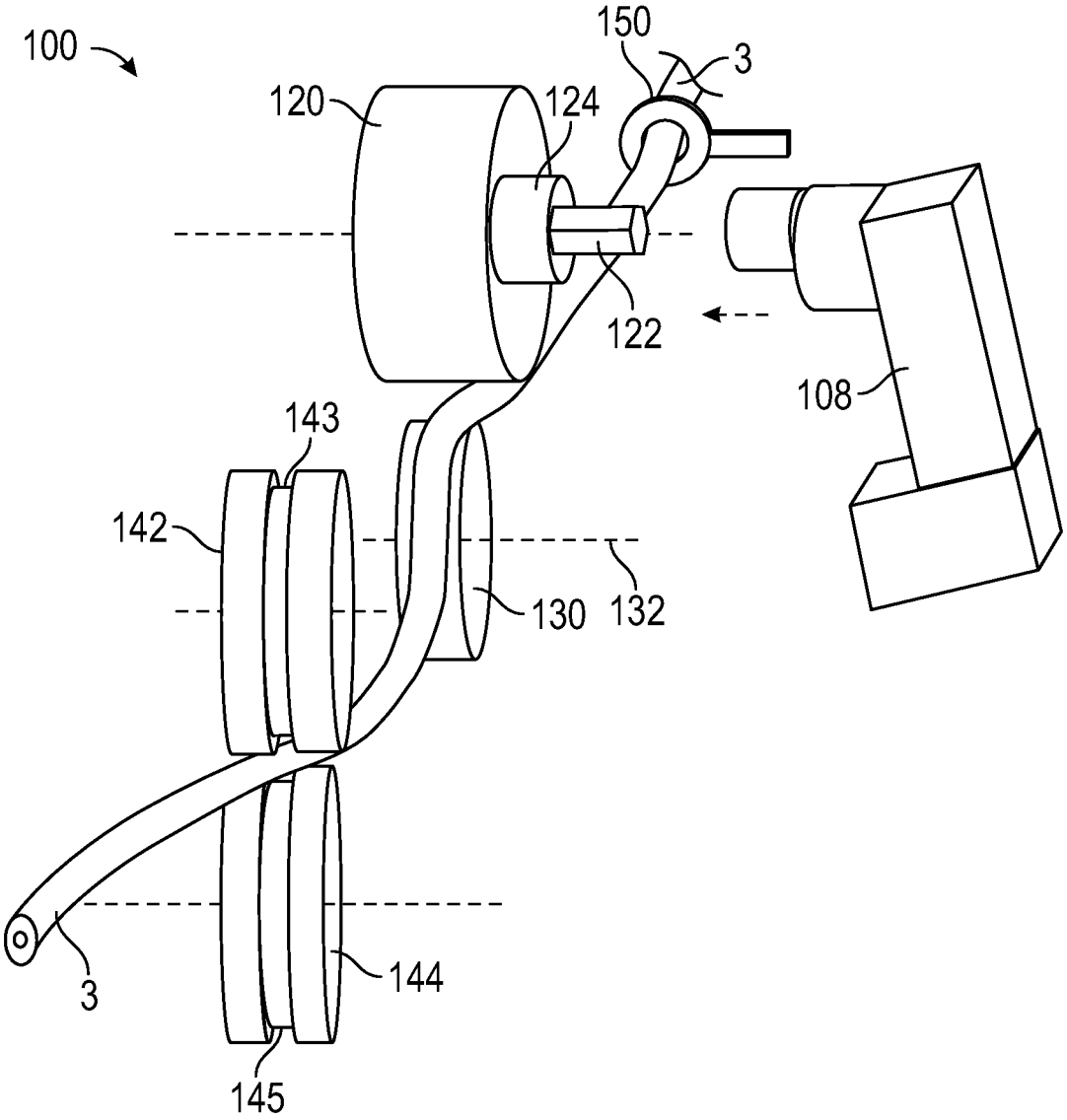
FIG. 11 is an isolated 3-D diagram of such operation showing components of the device in isolation from supporting frame.

With additional reference to FIGS. 10A and B in FIG. 11, methods and methods of use according to the invention are illustrated. These methods are in the context of exemplary embodiment 100, as mentioned, but the precise form and configuration of the apparatus could vary according to need or desire.

As discussed above, to prepare unit 100 for operation, once unit 100 has been mounted to a duct rodder 1 in a fixed manner to duct rodder frame 9, pivot arm 134 can be loosened and dropped to drop pinch roller away from drive wheel 120. Duct rodding 3 can be threaded through eye-bolt 150 (or similar structure), under drive wheel 120, and through guide wheels 142 and 144. Swing arm 134 can be pulled up to pinch duct rod 3 to the underside of drive wheel 120. Swing arm 134 can be tightened at that position. As further mentioned, the operator can, with little effort and quickly, fine-tune the amount of pinching to need or desire.

Then, to provide powered assist to unit 100, electric battery drill or driver 108 can be brought to the exposed axle 122 on unit 100 and have the drill's chuck tightened on drive axle 122 on the opposite side of plate frame 102. Rotation of the chuck of drill 108 in either direction facilitates rotation of drive wheel 120, which influences movement of duct rod 3 for unwinding from duct rodder 1 from unwinding or winding onto it. Through easy and intuitive operation of a conventional tool such as a battery-powered drill or driver, the user can control direction, amount, and speed of unwinding and winding for any desired period of time or multiple periods of time. The user has manual and precise control by simply operating the drill or tool 108.

The inventor has tested and confirmed that commercial grade battery powered drills such as are available from a variety of manufacturers in fully charged condition can unwind substantially all of a typical coil of duct rod 3 and wind it back in. Obviously, an additional advantage of this embodiment of the invention is that even if the battery power drill 108 does lose charge to not be effective, a battery can be replaced, or another battery power driver switched in to immediately continue.

It can therefore be seen that the invention achieves a least one or more of its objects, features, aspects, and advantages. As can be seen, basically a mountable assembly 100 less than the diameter of duct rodder frame 9, elongated along its horizontal diameter can be fixed to frame 9. The duct rodding 3 can be threaded through assembly 100 quickly and easily. Assembly 100 can be adjusted for optimal performance for given conditions. Assembly 100 uses noncomplex mechanical principles with a subtle utilization of a specific drive wheel 120 and pinching wheel to take advantage of a separate, portable, hand sized power source.

Additional features can be beneficial including guide wheels on the downstream side of drive wheel 120, and a guide member on the upstream side, but are not necessarily required.

Mountable assembly 100 is robust, will withstand harsh environmental outdoor conditions, and can easily be repaired or replaced.

FIGS. 3A-E, 4A-B, 5A-B, 6A-B, 7A-B, and 8A-B are additional views of the combination of unit 100 on a duct rodder 1, including certain viewing angles and specific portions that are shown both on duct rodder 1 and then either enlarged or isolated, to give additional information about how to make and use unit 100 on a duct rodder 1 according to one non-limiting specific embodiment.

As can be seen, this embodiment 1 achieves one or more of the stated aspects according to the invention. Unit 100 is relatively small and unobtrusive along the side of duct rodder 1 when mounted. It can be added and removed. It does not carry its own power source but rather has the important but subtle benefit of being powered by a separate portable battery-powered tool.

That tool needs to be attached only when duct rodding 3 needs to be unwound or wound onto the cage/reel 8 of duct rodder 1, but can easily and quickly be removed and, if needed, used for other tasks.

C. Apparatus and Operation of Second Exemplary Embodiment

Figure 12A:
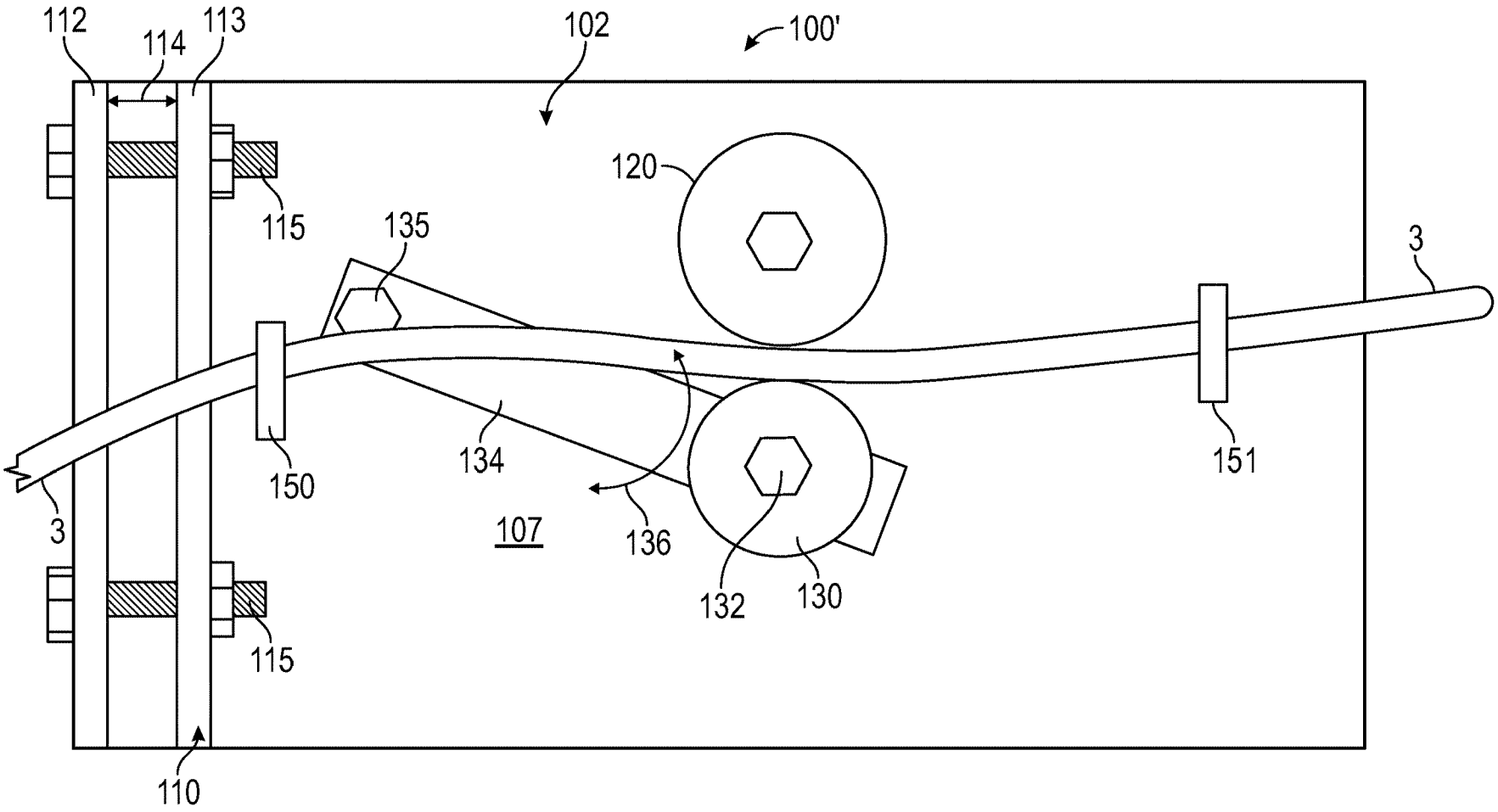
FIGS. 12A-B and 13 are similar to FIGS. 10A-B and 11, but are an alternative embodiment according to aspects of the invention.
Figure 12B:
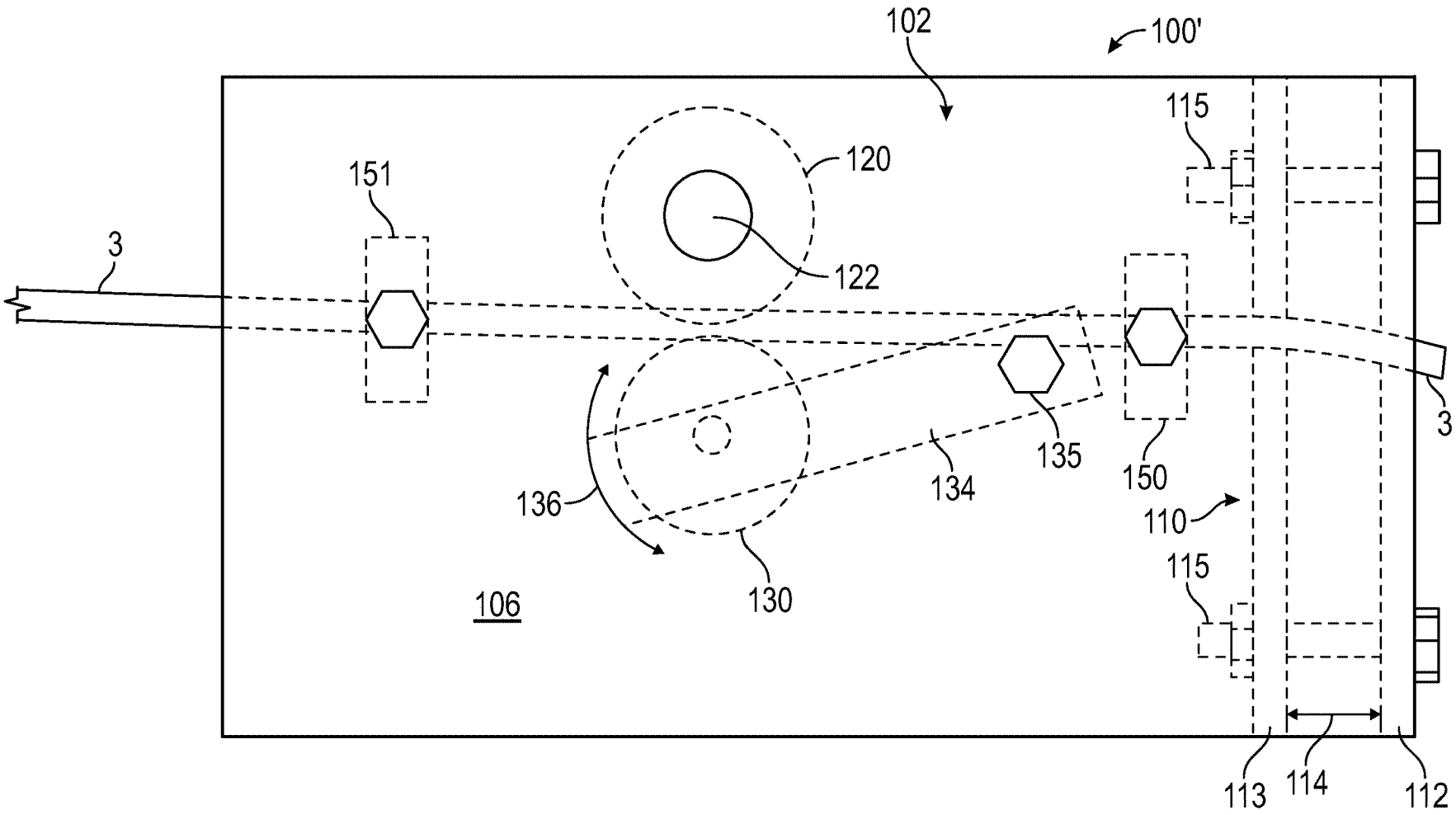
Figure 13:
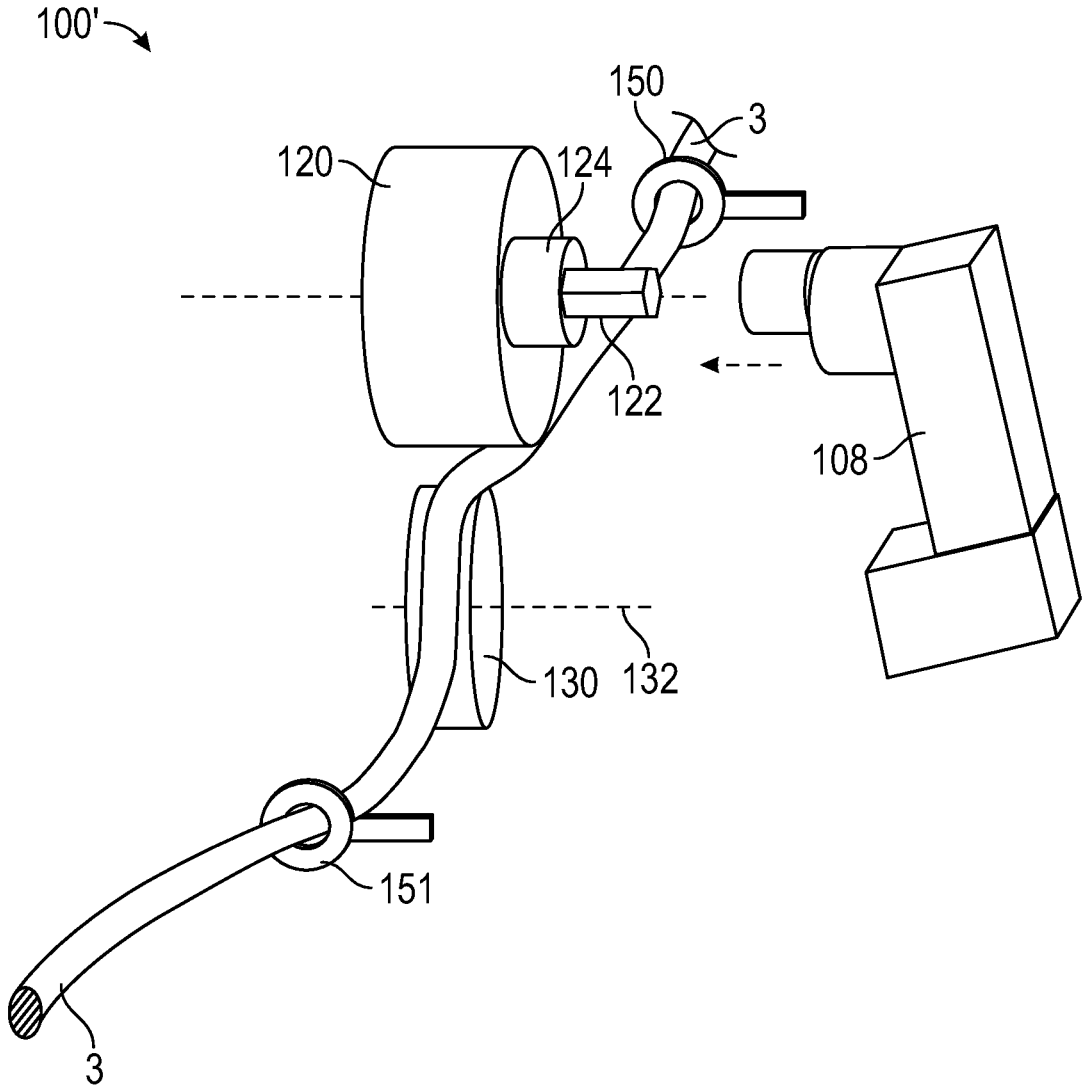
Figure 14E:
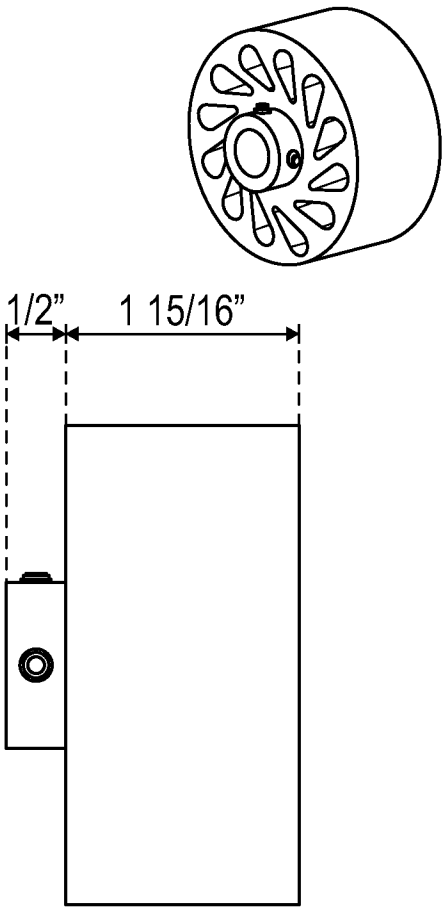
Figure 14E:
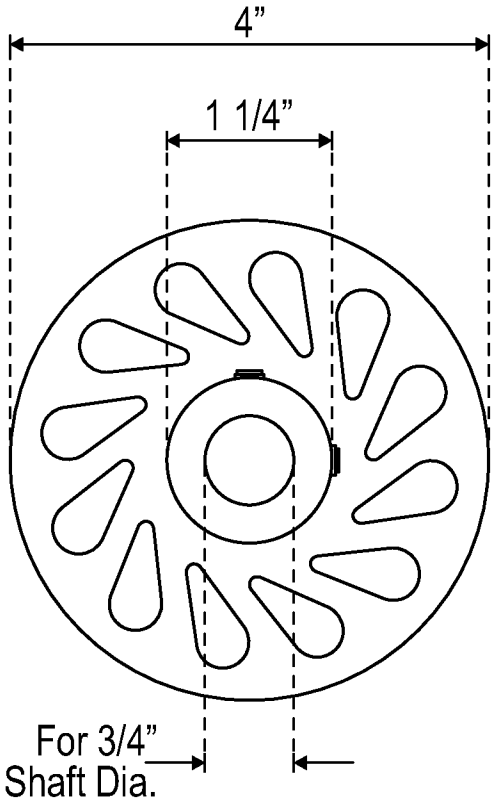

With particular reference to FIGS. 12A-B and 13, an alternative embodiment mountable assembly or unit 100' according to aspects of the invention is illustrated. It is similar to the First Embodiment of FIGS. 10A-B and 11 with the following main difference.

Figure 10B:
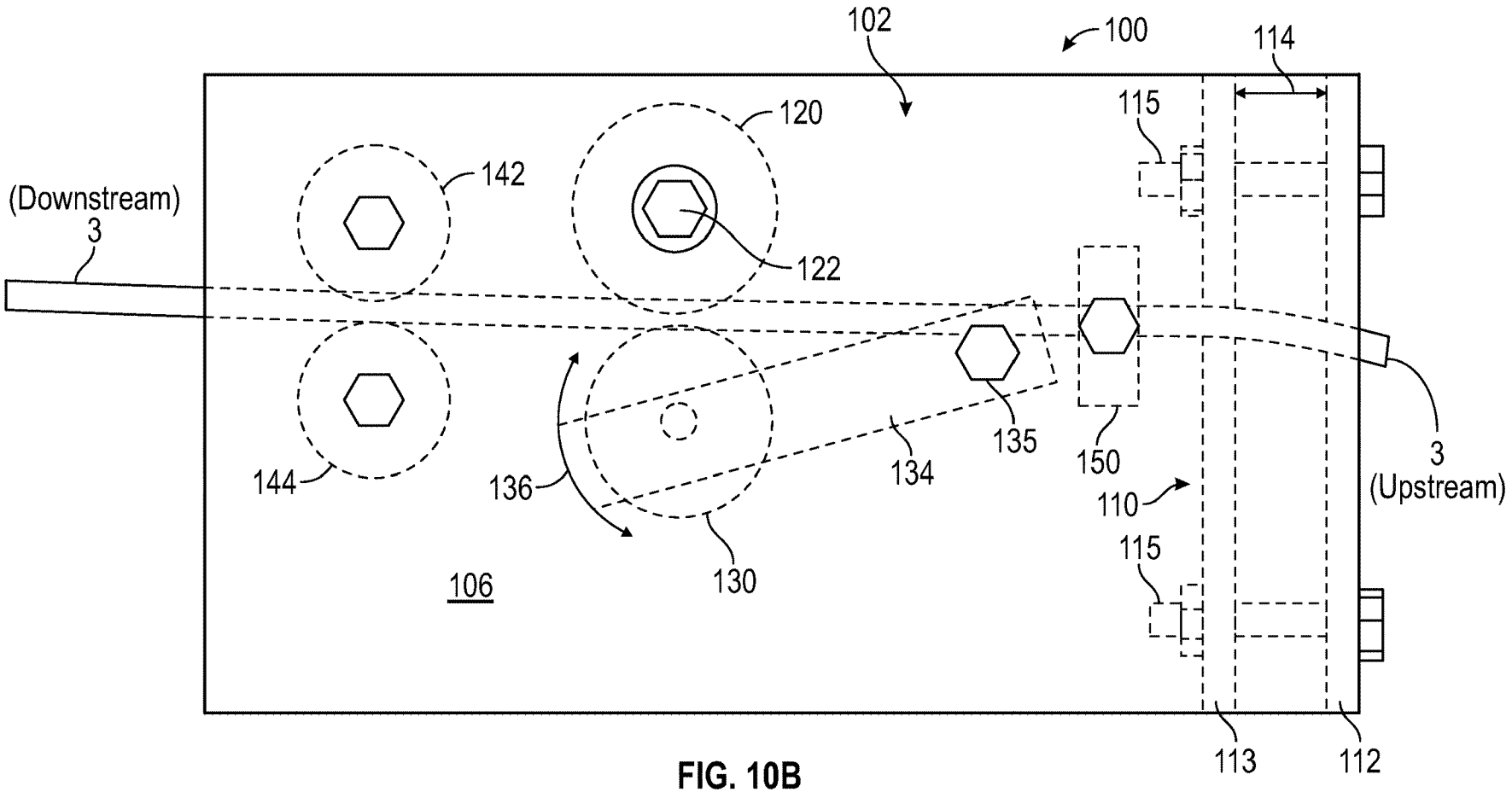

Instead of exit guide wheels 142 and 144 of FIGS. 10A-B and 11, an eye hook 151 is mounted on frame 102 on its downstream end 105, and guides the downstream end of duct rod 3 to and from that end 105, and aligns duct rod 3 with drive and pincher wheels 120 and 130. Eye hook 151 can have a threaded end that allows a nut to fasten it to frame 102. As will be appreciated other ways to guide duct rod 3, both at frame end 105 and frame end 104, are possible.

As can be seen, this embodiment 2 achieves one or more of the stated aspects according to the invention. Unit 100' is relatively small and unobtrusive along the side of duct rodder 1 when mounted. It can be added and removed. It does not carry its own power source but rather has the important but subtle benefit of being powered by a separate portable battery-powered tool. That tool needs to be attached only when duct rodding 3 needs to be unwound or wound onto the cage/reel 8 of duct rodder 1, but can easily and quickly be removed and, if needed, used for other tasks.

D. Other Options and Alternatives

It will be appreciated by those skilled in the art that variations to the exemplary embodiments are possible and that the exemplary embodiments are not limiting of the forms and embodiments the invention can take.

Below are some non-limiting examples.

1. Form Factor/Scale

As will be appreciated by those skilled in the art, the form factor (shape/size) can vary according to need or desire. The exemplary embodiments 1 and 2 illustrate one non-limiting form factor and scale that is effective for a range of typical duct rodders 1. But variations of form factor and scale are possible.

The exemplary embodiments 1 and 2 illustrate one non-limiting form factor and scale that would be effective for other types of conduit than duct rodding, so long as the diameter is smaller than the perimeter width of the drive wheel 120.

There may be some upper limit on the size of conduit that can be serviced by the invention. That possible upper limit may relate to limits on power on battery-powered drills or drivers. However, as is well-known to those skilled in the art, those power limits are quite high given the improvements in torque and battery life for such tools, including with professional grade portable battery-powered rotary tools.

2. Conduits

As mentioned, the exemplary embodiments are discussed principally in the context of duct rodders and duct rodding of fiberglass, but one or more aspects of the invention can be applied in analogous ways to other coiled conduit. Variations obvious to those skilled in the art might be needed for some other conduit depending on its diameter, outer surface, flexibility, and mass. Any coiled conduit that can be fed from or onto a reel or cage may benefit from one or more aspects of the invention.

3. Materials

As mentioned, the materials used for components of unit 100 can vary according to desire or need.

What is claimed is:

1. An assembly mountable to and along the side of a stand of a duct rodder rotatable cage or reel for coiled duct rodding or other conduit for power assist of unwinding and winding of duct rodding or other conduit comprising:

a. a hand portable plate frame having upstream and downstream opposite ends and drive wheel and drill opposite sides along a longitudinal axis, top and bottom opposite edges spaced from the longitudinal axis, and a supporting member along its top edge for structural robustness, the plate frame having perimeter dimensions small enough for a user to carry the hand portable plate;

b. a drive wheel having a perimeter diameter rotatably mounted on the drive wheel side and towards the top edge of the plate frame and having a drive axle structurally supported by a steel hub and bushing extending from the drill opposite side and having a distal end for selective operative releasable engagement to a rotary driving output of a hand-operated battery powered drill or rotary tool, the drive wheel perimeter diameter being smaller than the distance between the top and bottom edges of the plate frame;

c. an adjustable pinch wheel having a perimeter diameter rotatably mounted on the drive wheel side and towards the bottom edge of the plate frame on an adjustment mechanism that is selectively translatable towards and away from the drive wheel and fixable into position for adjustable pinching force on duct rodding or other conduit relative the drive wheel, the pinch wheel perimeter diameter being smaller than the distance between the top and bottom edges of the plate frame;

d. a mounting interface at the upstream end of the plate frame comprising spaced apart clamping plates defining a receiver configured to selectively removably receive and clamp or affix the plate frame with drive and pinch wheels to a stand of a duct rodder rotatable cage or reel for coiled duct rodding or other conduit with adjustable clamping hardware;

e. a guide member on the plate frame upstream of the drive wheel comprising an opening configured to threadably receive and guide duct rodding to the drive wheel from the upstream end and generally along the longitudinal axis of the plate frame;

f. a guide member on the plate frame downstream of the drive wheel comprising an opening to threadably receive and guide duct rodding from the drive wheel and generally along the longitudinal axis and away from the downstream end of the plate frame; and g. the drive wheel comprises a radially compressible resilient elastic body.

2. The apparatus of claim 1 wherein the guide member upstream of the drive wheel comprises an eye bolt through which duct rodding or other conduit can slidably pass.

3. The apparatus of claim 1 wherein the guide member downstream of the drive wheel comprises an eye bolt through which duct rodding or other conduit can slidably pass.

4. The apparatus of claim 1 wherein the pinching wheel adjustment comprises a swing arm that swings on a tightenable pivot a free end towards or away from the drive wheel.

5. The apparatus of claim 1 wherein the drive wheel comprises:

a. a neoprene body;

b. a perimeter width of at least an inch; and c. transverse slots through the body.

6. The apparatus of claim 1 in combination with a duct rodder unit comprising a stand and rotatable cage or reel for coiled duct rodding or other conduit.

7. A method of assisting winding and unwinding of a duct rodder unit comprising a stand and rotatable cage or reel for coiled duct rodding or other conduit comprising:

a. releasably mounting a hand portable frame to a stand of a duct rodder unit rotatable cage or reel for coiled duct rod or other conduit, wherein the hand portable frame has perimeter dimensions small enough for a user to carry the hand portable plate and comprises:

i. a drive wheel;

ii. an adjustable pinching wheel that is adjustable as far as closeness to the drive wheel;

iii. a mounting interface adapted for selective releasable mounting to a stand of a rotatable cage or reel for duct rodding or other conduit;

iv. a guide member on the portable frame upstream of the drive wheel configured to guide duct rodding to the drive wheel;

v. a guide member on the portable frame downstream of the drive wheel to guide duct rodding from the drive wheel and frame; and vi. the drive wheel comprises a radially compressible body;

b. pinching the duct rodding or other conduit between the drive wheel and the adjustable pinching wheel; and c. rotating the drive wheel with a detachable battery powered drill or rotary tool, wherein the direction of rotation of the drill or rotary tool unwinds or winds the duct rodding or other conduit from or to the duct rodder unit.

8. The method of claim 7 further comprising operating the drive wheel to move the duct rodding or other conduit upstream or downstream relative the drive wheel.

9. The method of claim 7 wherein the drive wheel comprises:

a. a steel hub for shaft mounting the drive wheel to an axle;

b. a neoprene body mounted on the steel hub, the neoprene body, sidewall openings that allow some compressibility radially, and a soft flat profile perimeter drive surface.

10. A system for power assist of unwinding and winding of duct rodding or other conduit from a stand and rotatable cage or reel for coiled duct rodding or other conduit comprising:

a. an assembly adapted for selectively removably clamping or affixing to a stand of a duct rodder rotatable cage or reel for coiled duct rodding or other conduit, the assembly having perimeter dimensions small enough for a user to carry the hand portable plate comprising:

i. a hand portable frame including a mounting interface configured for removably mounting to a stand of a duct rodder cage or reel for coiled duct rodding or other conduit;

ii. a drive wheel rotatably mounted on the portable frame and having a drive axle adapted for selective releasable operative engagement to rotary output of a battery powered drill or rotary tool, and a radially compressible body with an outer perimeter surface with a width effective to frictionally engage and convey duct rodding or other conduit upon rotation of the drive wheel without damaging the duct rodding or other conduit;

iii. a guide member on the portable frame upstream of the drive wheel configured to guide duct rodding to the drive wheel; and iv. a guide member on the portable frame downstream of the drive wheel to guide duct rodding from the drive wheel and frame.

11. The system of claim 10 wherein the drive wheel comprises neoprene.

12. The system of claim 11 wherein the neoprene comprises a plurality of openings.

13. The system of claim 10 in combination with:

a. a stand and cage or reel of coiled duct rodding or other coiled conduit; and b. a battery powered hand-operated drill or rotary tool.

* * * * *